US012082621B2

(12) United States Patent
Boldrini

(10) Patent No.: US 12,082,621 B2
(45) Date of Patent: Sep. 10, 2024

(54) MACHINE AND METHOD FOR THE PRODUCTION OF A CARTRIDGE FOR AN ELECTRONIC CIGARETTE

(71) Applicant: G.D SOCIETA' PER AZIONI, Bologna (IT)

(72) Inventor: Fulvio Boldrini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 508 days.

(21) Appl. No.: 17/424,745

(22) PCT Filed: Jan. 21, 2020

(86) PCT No.: PCT/IB2020/050448
§ 371 (c)(1),
(2) Date: Jul. 21, 2021

(87) PCT Pub. No.: WO2020/152584
PCT Pub. Date: Jul. 30, 2020

(65) Prior Publication Data

US 2022/0087324 A1 Mar. 24, 2022

(30) Foreign Application Priority Data

Jan. 21, 2019 (IT) ..... 102019000000869

(51) Int. Cl.
*A24F 40/70* (2020.01)
*A24F 7/00* (2006.01)
(Continued)

(52) U.S. Cl.
CPC ..... *A24F 40/70* (2020.01); *A24F 7/00* (2013.01); *A24F 40/10* (2020.01); *A24F 40/42* (2020.01); *A24F 40/44* (2020.01); *A24F 40/46* (2020.01)

(58) Field of Classification Search
CPC .. A24F 40/70; A24F 7/00; A24F 40/10; A24F 40/42; A24F 40/44; A24F 40/46
(Continued)

(56) References Cited

U.S. PATENT DOCUMENTS 9,743,689 B2 * 8/2017 Sikora ..... A24C 5/34
9,833,019 B2 * 12/2017 Ampolini ..... A61M 11/042
(Continued)

FOREIGN PATENT DOCUMENTS

WO WO-2013/076750 A1 5/2013
WO WO-2018/078565 A1 5/2018

OTHER PUBLICATIONS

International Search Report and Written Opinion, corresponding International application No. PCT/IB2020/050445, mailing date May 27, 2020.
(Continued)

*Primary Examiner* — Alexander Gilman
(74) *Attorney, Agent, or Firm* — MARSHALL, GERSTEIN & BORUN LLP

(57) ABSTRACT

A manufacturing machine and method for producing a cartridge for an electronic cigarette includes a first assembling drum mounted rotatable around a first rotation axis and has a first seat to house a support of a heating device coupled to a wick with an electrical coil, and a second seat axially aligned with the first seat and designed to house a tank. At a first feeding station, a support of a heating device coupled to a wick with an electrical coil is fed into the first seat. At a second feeding station, a tank is fed into the second seat. A first insertion station is arranged downstream of the first and second feeding stations and provided with a first pushing device, which axially moves the support of a heating device from the first seat to the second seat to insert the support into a tank carried by the second seat.

15 Claims, 35 Drawing Sheets

(51) Int. Cl.

| | |
|---|---|
| ***A24F 40/10*** | (2020.01) |
| ***A24F 40/42*** | (2020.01) |
| ***A24F 40/44*** | (2020.01) |
| ***A24F 40/46*** | (2020.01) |

(58) Field of Classification Search
USPC ..... 131/329
See application file for complete search history.

(56) References Cited

U.S. PATENT DOCUMENTS

| | | | | |
|---|---|---|---|---|
| 9,861,139 | B2 * | 1/2018 | Boldrini | H05K 13/00 |
| 9,862,060 | B2 * | 1/2018 | Boldrini | B23K 37/0435 |
| 10,212,969 | B2 * | 2/2019 | Lemay | A24F 40/70 |
| 10,306,917 | B2 * | 6/2019 | Slowik | A24D 3/0287 |
| 10,653,176 | B2 * | 5/2020 | Zadecki | B65G 47/848 |
| 11,191,305 | B2 * | 12/2021 | Madera | A24F 40/70 |
| 2012/0077659 | A1 * | 3/2012 | Yanchev | A24D 3/0287 493/39 |
| 2015/0251854 | A1 * | 9/2015 | Druzdzel | A24C 5/35 198/339.1 |
| 2015/0289565 | A1 * | 10/2015 | Cadieux | A24F 40/70 131/328 |
| 2015/0291301 | A1 | 10/2015 | Cadieux et al. | |
| 2016/0106151 | A1 * | 4/2016 | Swepston | A24C 5/327 29/729 |
| 2016/0143362 | A1 * | 5/2016 | Boldrini | B23P 21/004 29/742 |
| 2016/0143363 | A1 * | 5/2016 | Boldrini | B23P 21/004 29/874 |
| 2017/0360083 | A1 * | 12/2017 | Cieslikowski | A24D 3/0287 |
| 2018/0153218 | A1 * | 6/2018 | Verleur | H05B 3/44 |
| 2018/0179042 | A1 * | 6/2018 | Garthaffner | B67C 3/225 |
| 2018/0184710 | A1 * | 7/2018 | Tucker | A24F 40/42 |
| 2018/0295880 | A1 * | 10/2018 | Swepston | A24F 40/70 |
| 2018/0303160 | A1 * | 10/2018 | Davis | A24F 40/40 |
| 2018/0338529 | A1 * | 11/2018 | Weigensberg | A24F 40/40 |
| 2018/0343926 | A1 * | 12/2018 | Wensley | A24F 40/44 |

OTHER PUBLICATIONS

International Search Report and Written Opinion, corresponding International application No. PCT/IB2020/050446, mailing date May 27, 2020.

International Search Report and Written Opinion, corresponding International application No. PCT/IB2020/050448, mailing date May 27, 2020.

* cited by examiner

MACHINE AND METHOD FOR THE PRODUCTION OF A CARTRIDGE FOR AN ELECTRONIC CIGARETTE

CROSS-REFERENCE TO RELATED APPLICATIONS

This patent application is a U.S. national phase of International Patent Application No. PCT/IB2020/050448 filed Jan. 21, 2020, which claims the benefit of priority from Italian patent application no. 102019000000869 filed on Jan. 21, 2019, the respective disclosures of which are each incorporated herein by reference in their entireties.

TECHNICAL FIELD

The present invention relates to a machine and to a method for the production of a cartridge for an electronic cigarette.

PRIOR ART

A type of electronic cigarette has recently been proposed comprising a reusable part that is used several times and contains, among other things, an electric battery (which provides the energy necessary for the operation of the electronic cigarette) and an electronic processor that oversees the operation of the electronic cigarette. Furthermore, the electronic cigarette comprises a single-use cartridge (i.e. disposable which is, therefore, used only once and is then substituted) which is coupled to the reusable part. Said single-use cartridge has a relatively complex construction and is currently produced (assembled) in a substantially manual manner (i.e. slowly, with high production costs, and with very variable quality standards).

The patent application US2018295880A1 describes an assembling drum and a method for using the assembling drum in the automated production of electronic cigarettes.

The patent application WO2013076750A1 describes a method for the production of a mouthpiece for an electronic cigarette; the mouthpiece comprises an external casing made of filter paper in which a piece of filtering material and a cartridge containing a liquid are inserted in series.

DESCRIPTION OF THE INVENTION

The aim of the present invention is to provide a machine and a method for the production of a cartridge for an electronic cigarette, which machine and method allow to achieve high productivity and are, at the same time, easy and inexpensive to manufacture.

According to the present invention, a machine and a method for the production of a cartridge for an electronic cigarette are provided, according to what is claimed in the attached claims.

The claims describe embodiments of the present invention forming an integral part of the present description.

BRIEF DESCRIPTION OF THE DRAWINGS

The present invention will now be described with reference to the attached drawings, which illustrate a non-limiting example of embodiment, wherein.

PREFERRED EMBODIMENTS OF THE INVENTION

Figure 1:
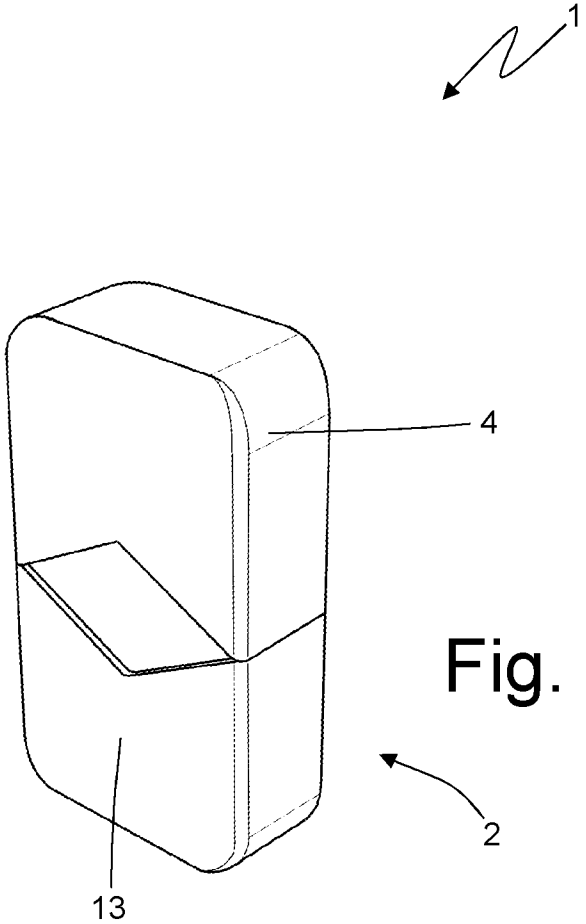
FIG. 1 is a perspective view of a cartridge for an electronic cigarette.
Figure 2:
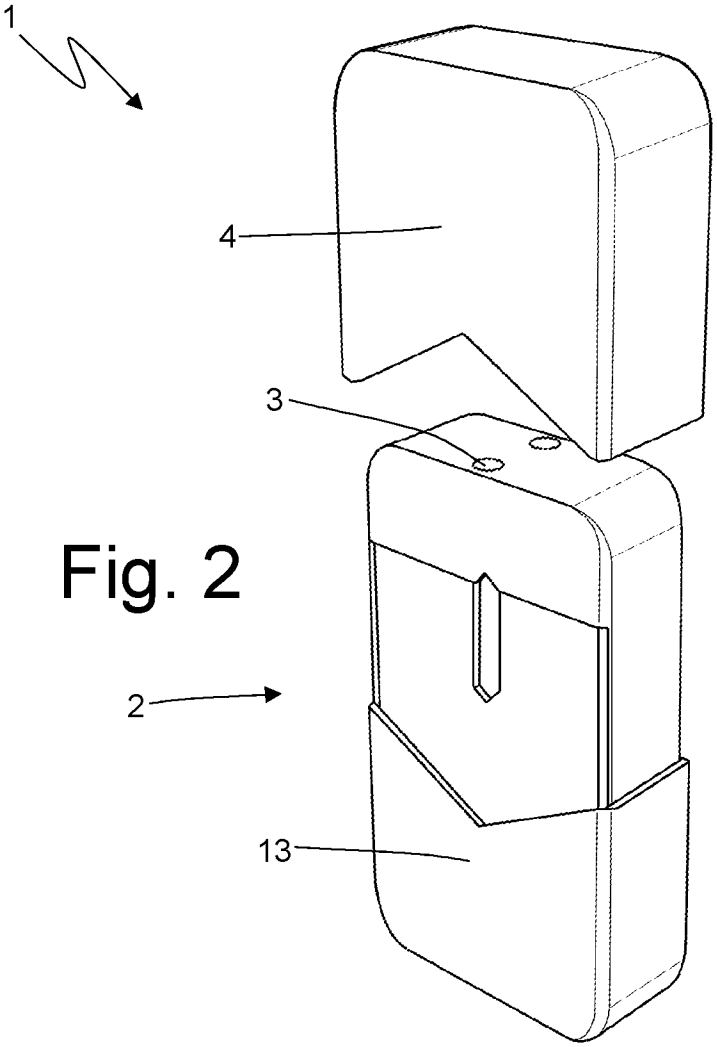
FIG. 2 is a perspective view of the cartridge of FIG. 1 with the removal of a removable cap.

In FIGS. 1 and 2, number 1 denotes as a whole a single-use cartridge (i.e. disposable which is therefore used only once and is then substituted) of a known type for an electronic cigarette.

The electronic cigarette comprises a parallelepiped shaped reusable part that is used several times and contains, among other things, an electric battery (which supplies the energy necessary for the operation of the electronic cigarette) and an electronic processor that oversees the operation of the electronic cigarette; a new single-use cartridge 1 is coupled to the reusable part to be used (i.e. to be "smoked") and is thrown away after use to be replaced with a new single-use cartridge 1.

The cartridge 1 comprises a substantially parallelepiped shaped main body 2, which, in use, is coupled to an electronic cigarette from which it receives the electric power-supply through two electrical contacts 3 arranged at a lower base of the main body 2. Furthermore, the cartridge 1 comprises a cap 4 which slips on the main body 2 to cover the area where the two electrical contacts 3 are arranged.

Figure 3:
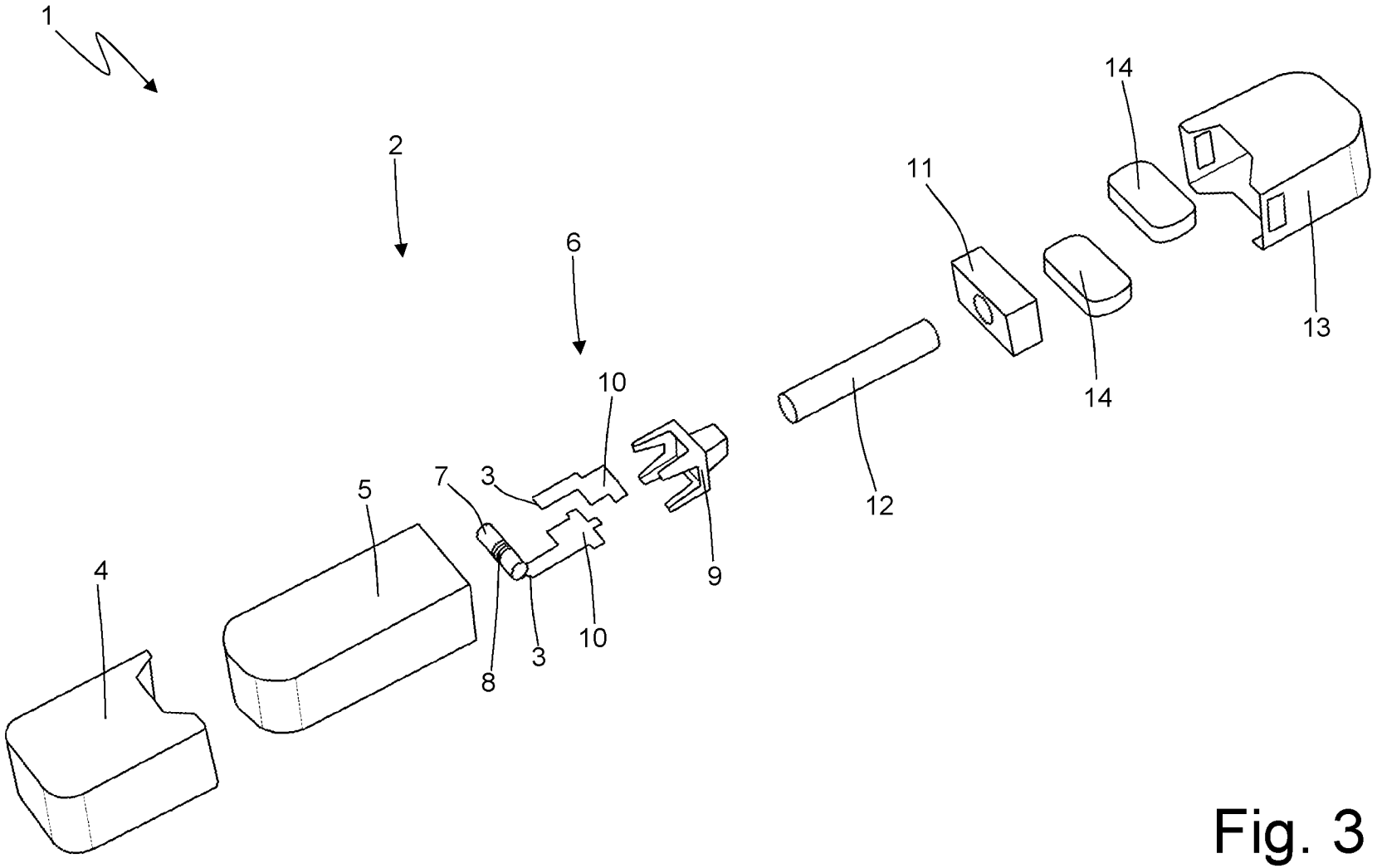
FIG. 3 is an exploded perspective view of the cartridge of FIG. 1 with the removal of a removable cap.

As illustrated in FIG. 3, the main body 2 of the cartridge 1 is mainly formed by a tank 5 which is substantially parallelepiped shaped and is internally hollow to contain, inside, a quantity of a viscous liquid substance containing nicotine and any flavours suitable to be evaporated by heating.

The cartridge 1 comprises a heating device 6, which is inserted inside the tank 5 at one end of the tank 5 (arranged near the cap 4) and is electrically connected to the two electrical contacts 3. In particular, the heating device 6 comprises a wick 7, which is cylindrical shaped and made of plastic material (therefore electrically insulating) suitably heat-resistant, and an electrical winding 8 (i.e. a coil) formed by a thin wire of an electrically conductive material (typically copper) externally provided with an electrically insulating enamel layer; the electrical coil 8 (which forms a thermal resistance) is spirally wound around the wick 7 and has two opposite ends (i.e. a start and an end of the electrical coil 8) which protrude perpendicularly to the wick 7 and are electrically connected to the two electrical contacts 3. Preferably, the heating device 6 comprises a support 9 which is shaped like a "fork" and has two "U"-shaped cavities inside which the wick 7 of the heating device 6 is arranged.

The cartridge 1 comprises two conductor elements 10, which are inserted into the tank 5 at one end of the tank 5 (arranged near the cap 4), are made of an electrically conductor material and each have an external end that protrudes from the tank and defines a corresponding electrical contact 3 and an inner end which is connected to a corresponding end of the electrical coil 8 of the heating device 6.

The cartridge 1 comprises a plug 11 made of an elastic material (for example made of silicone rubber) which is inserted into an end of the tank 5 opposite to the cap 4 (i.e. opposite to the electrical contacts 3) for sealing the tank 5 and has a central through hole.

The cartridge 1 comprises a tube 12 which is arranged through the plug 11 of the tank 5 (i.e. through the through hole of the plug 11) to set the inside of the tank 5 in communication with the outside of the tank 5; in particular, the support 9 of the heating device 6 comprises a through duct (i.e. that crosses the support 9 from one side to the other) in which it connects to the tube 12 (i.e. it forms the continuation of the tube 12 through the support 9).

The cartridge 1 comprises a mouthpiece 13 which, in use, is designed to be inserted into the mouth of a user, is partially fitted around the tank 5 on the side opposite to the cap 4 (i.e. on the side opposite to the electrical contacts 3), and is connected to the tube 12; through the tube 12 the user can inhale, from the mouthpiece 13, the vapours that form inside the tank 5 due to the evaporation of the liquid created by the heat generated by the heating device 6.

Finally, the cartridge 1 comprises two absorbent pads 14 which are made of hygroscopic material, are arranged inside the mouthpiece 13 in direct contact with the tank 5, and have the function of absorbing and therefore retaining any traces of liquid that should reach the mouthpiece 13 through the tube 12 (thus avoiding that the user, by inhaling from the mouthpiece 13, can also inhale, the liquid together with the vapours).

Figure 4:
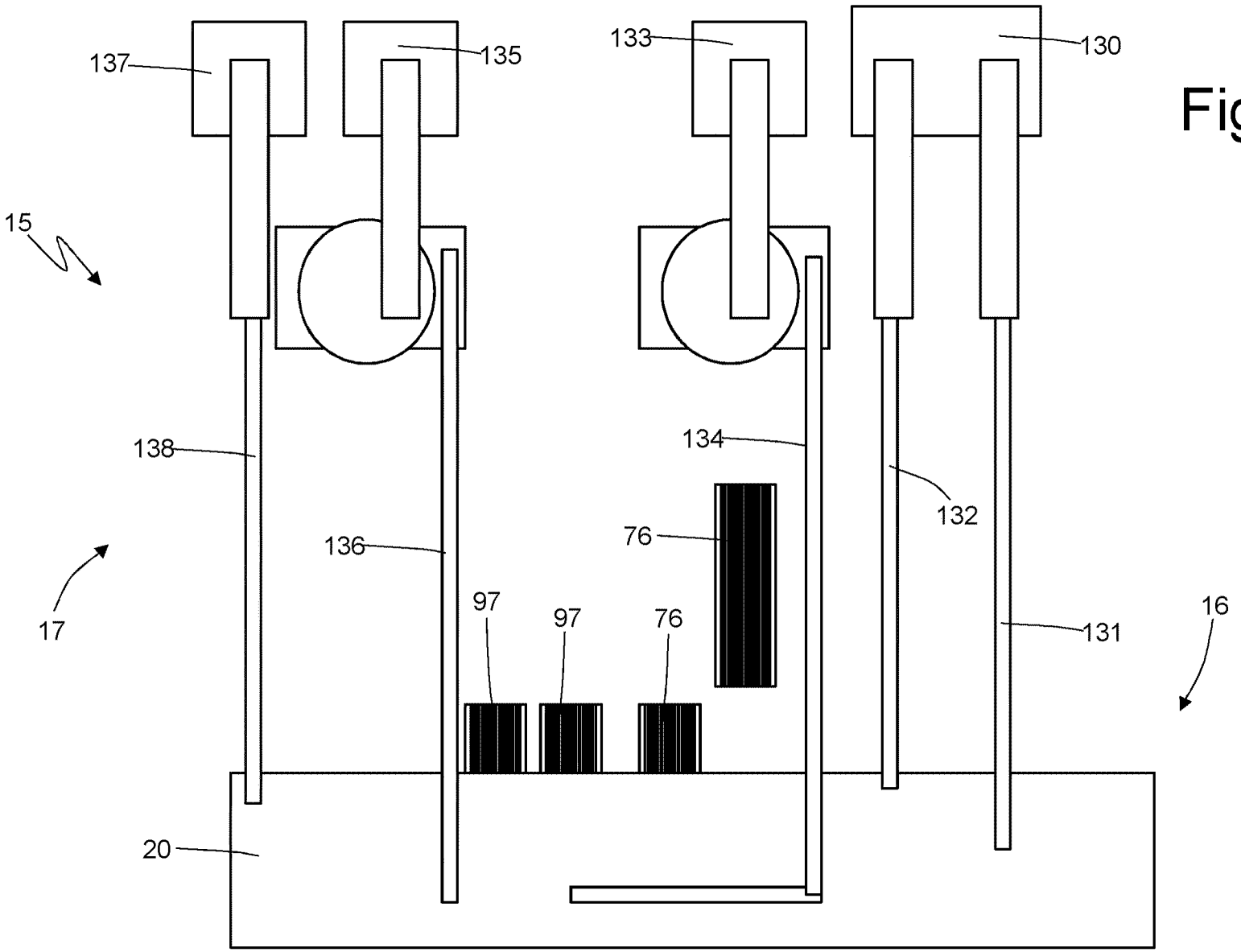
FIG. 4 is a plan and schematic view of a manufacturing machine for the production of the cartridge of FIG. 1 and made according to the present invention.

In FIG. 4, number 15 denotes as a whole a manufacturing machine for the production of the cartridges 1 for electronic cigarettes described above.

As illustrated in FIG. 4, the manufacturing machine 15 comprises an assembling section 16 in which the materials forming the cartridges 1 are assembled to manufacture the cartridges 1 and a feeding section 17, in which the materials forming the cartridges 1 are received and sorted towards the assembling section 16.

Figure 5:
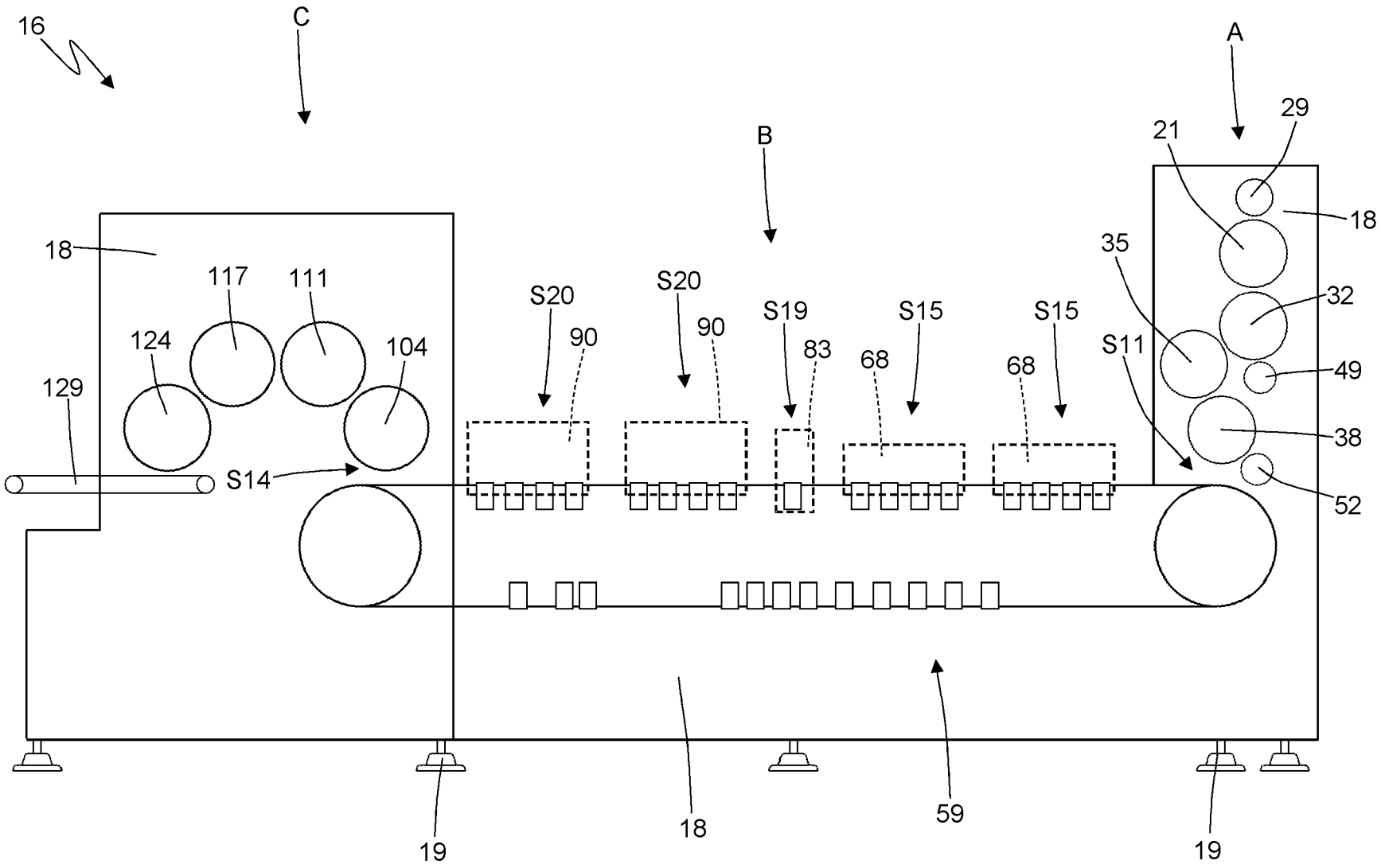
FIG. 5 is a front and schematic view of the manufacturing machine of FIG. 4.

As illustrated in FIG. 5, the assembling section 16 of the manufacturing machine 15 comprises an initial part A in which, initially the tube 12 and subsequently the conductor elements 10 are coupled to each support 9, an intermediate part B in which, the wick 7 is coupled to each support 9 provided with an electrical coil 8 wound in a spiral and two absorbent pads 14 are coupled to each mouthpiece 13, and a final part C in which, initially the support 9, provided with the wick 7 and with the tube 12, and subsequently the plug 11 are coupled to each tank 5, and in which to each tank 5 the mouthpiece 13 is coupled, thus completing the formation of the cartridge 1 where only the cap 4 is missing (which is applied downstream of the manufacturing machine 15 after filling the tank 5 with a quantity of viscous liquid substance containing nicotine). The manufacturing machine 15 comprises a support body 18 (i.e. a frame) which rests on the ground by means of legs 19 and has, at the front, a vertical wall on which the operating members of the three parts A, B and C are mounted. As illustrated in FIG. 4, the manufacturing machine 15 comprises a protective casing 20 which encloses, on the inside thereof, the support body 18, is provided with transparent windows, and is provided with doors which in use must remain closed and can be opened when the manufacturing machine 15 is on hold.

Figure 6:
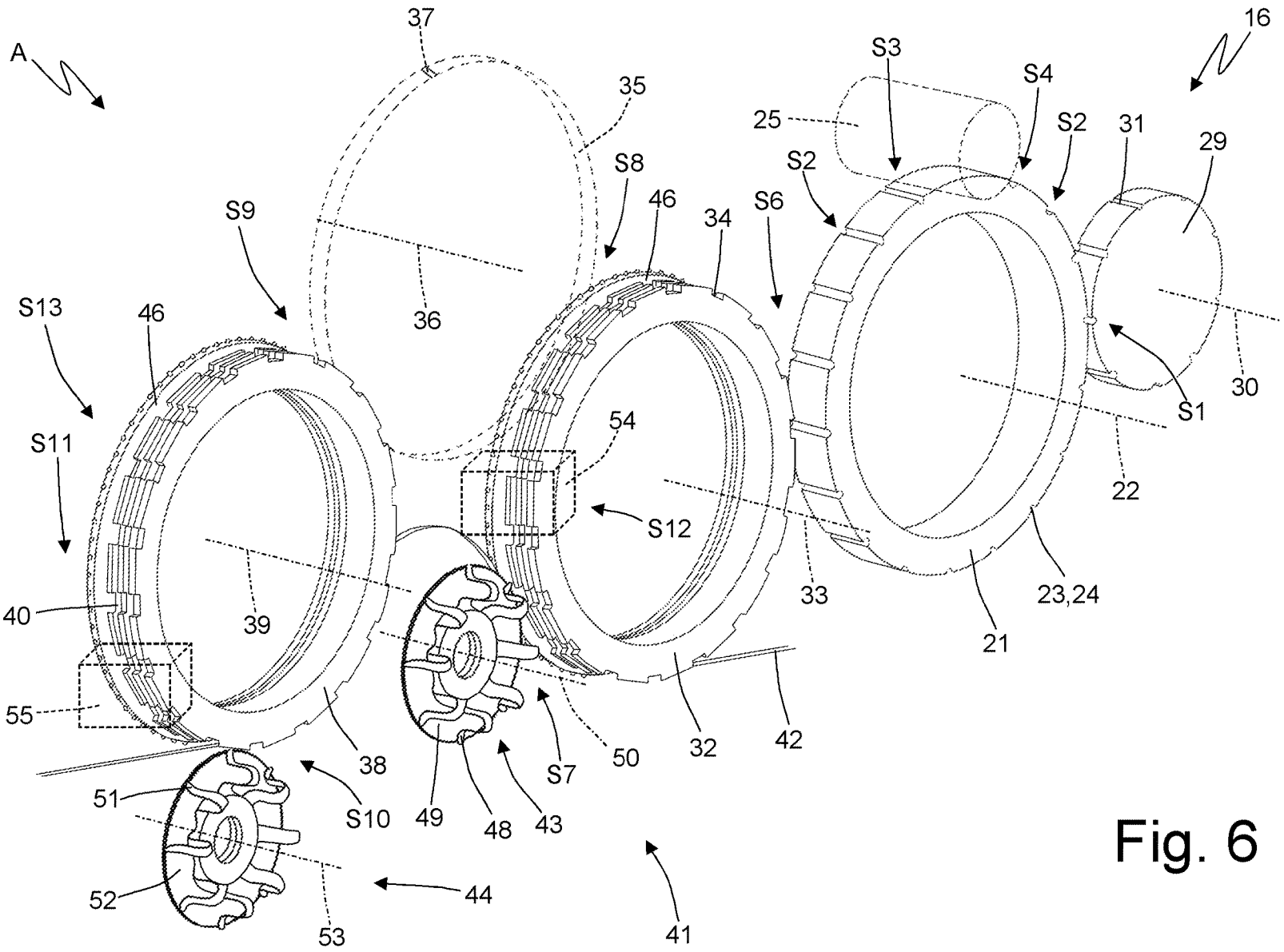
FIG. 6 is a perspective and schematic view of an initial part of the manufacturing machine of FIG. 4.

As illustrated in FIG. 6, the initial part A comprises an assembling drum 21, vertically arranged, which is mounted rotatable around a horizontal rotation axis 22 so as to rotate with intermittent motion (i.e. in a stepwise manner by cyclically alternating motion steps and still steps) around the rotation axis 22. The assembling drum 21 has a plurality of suction seats 23 each designed to house a tube 12 and a plurality of suction seats 24, each of which is axially aligned with a corresponding seat 23 and designed to house a support 9 of a heating device 6.

A feeding station S1 is provided in which a tube 12 is fed into each seat 23 of the assembling drum 21, and a feeding station S2 is provided, which is arranged downstream of the feeding station S1 relative to the rotation direction of the assembling drum 21 and in which a support 9 of a heating device 6 is fed into each seat 24 of the assembling drum 21.

Figure 7:
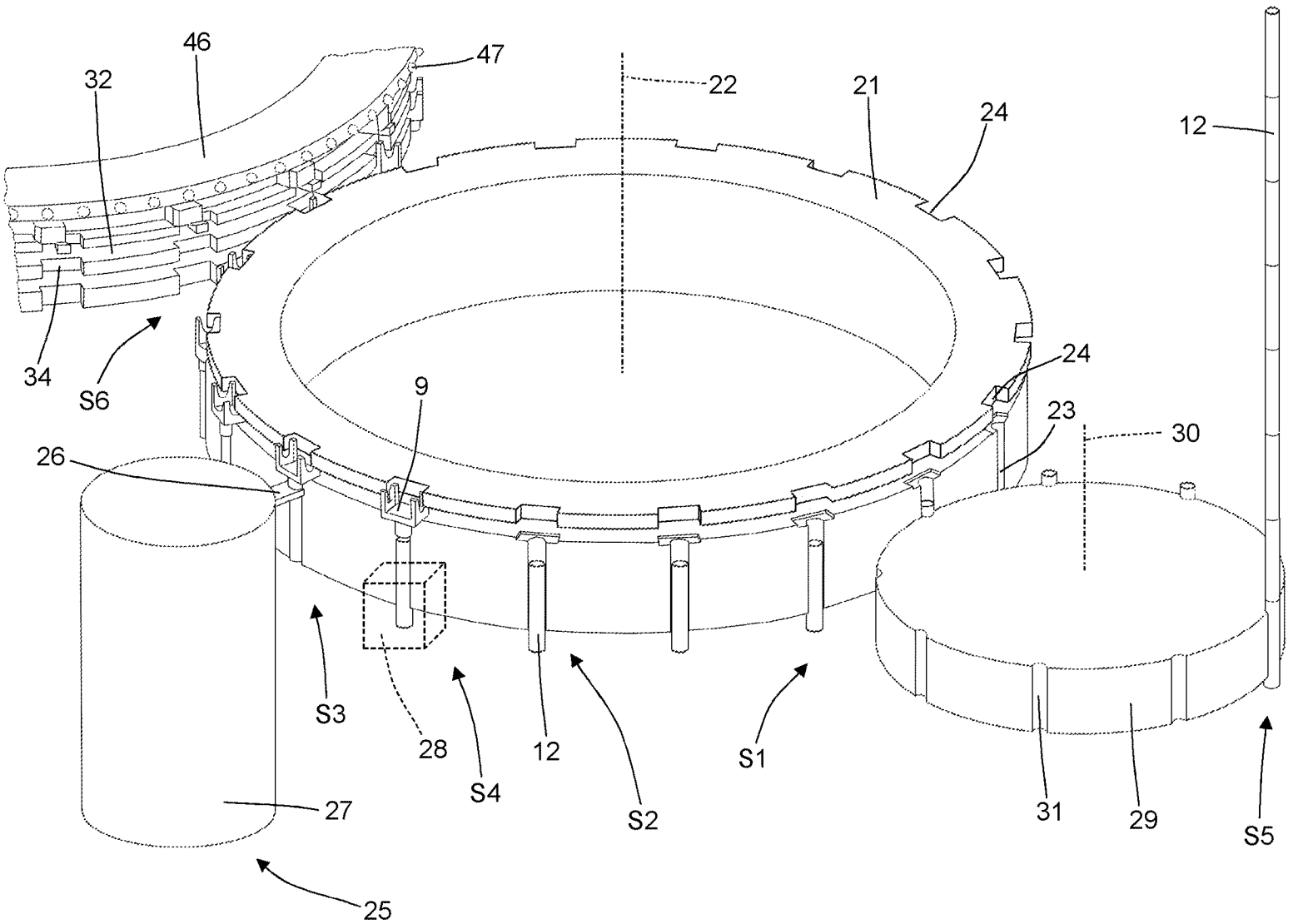
FIG. 7 is a view, on an enlarged scale, of an assembling drum of the initial part of FIG. 6.

A welding station S3 is provided, which is arranged downstream of the feeding station S1 and of the feeding station S2 and is provided with a welding device 25 (for example operating by means of ultrasound) which connects, by means of welding, a tube 12 carried by a seat 23 to a support 9 carried by the corresponding seat 24. As illustrated in FIG. 7, the welding device 25 comprises a welding body 26 which is "U"-shaped so as to partially embrace a tube 12 carried by a seat 23 and a support 9 carried by a corresponding seat 24; furthermore, the welding device 25 comprises an actuator 27 which moves the welding body 26 radially to the rotation axis 22 between a rest position, in which the welding body 26 is (relatively) far from the assembling drum 21 (when the assembling drum 21 rotates around the rotation axis 22) and a working position in which the welding body 26 is near to the assembling drum 21 (when the assembling drum 21 is still).

According to a possible embodiment, in the feeding station S2 a support 9 of a heating device 6 is fed into a seat 24 in contact with a tube 12 carried by the corresponding seat 23; in other words, already in the feeding station S2 a support 9 of a heating device 6 housed in a seat 24 is resting (in contact) on a tube 12 carried by the corresponding seat 23. According to an alternative embodiment illustrated in FIG. 7, in the feeding station S2 a support 9 of a heating device 6 is fed into a seat 24 at a given axial distance (different from zero) from a tube 12 carried by the corresponding seat 23; in this embodiment, an approach station S4 is provided which is arranged between the feeding station S2 and the welding station S3 relative to the rotation direction of the assembling drum 21 and is provided with a pushing device 28 which, at the inside each seat 23, axially moves a tube 12 so as to rest the tube 12 on a support 9 carried by the corresponding seat 24.

As better illustrated in FIG. 7, the initial part A comprises a feeding drum 29 which is mounted rotatable around a rotation axis 30 parallel to the rotation axis 22, rotates with intermittent motion around the rotation axis 30, having a plurality of suction seats 31 each designed to house a tube 12, and is tangent to the assembling drum 21 in the area of the feeding station S1. An input station S5 is arranged along the feeding drum 29 upstream of the feeding station S1 relative to the rotation direction of the feeding drum 29; a succession of tubes 12 is fed to the input station S5 by means of a conveyor (for example pneumatic) and in the input station S5 each tube 12 is axially inserted into a corresponding seat 31 of the feeding drum 29 standing still. According to a different embodiment not illustrated, the input station S5 is provided with a cutting device which separates a tube from a tubular body by means of a transversal cut. In use and when the feeding drum 29 is standing still, in the feeding station S1 a tube 12 is transferred from a seat 31 of the feeding drum 29 to a seat 23 of the assembling drum 21.

As illustrated in FIG. 6, the initial part A comprises an assembling drum 32 which is mounted rotatable around a rotation axis 33 parallel to the rotation axis 22 to rotate with intermittent motion (i.e. in a stepwise manner by cyclically alternating motion steps and still steps) around the rotation axis 33. The assembling drum 32 has a plurality of seats 34 each designed to house a support 9 of a heating device 6 (provided with a tube 12). The assembling drum 32 is tangent to the assembling drum 21 in a transfer station S6 where, when both the assembling drums 21 and 32 are standing still, a support 9 is transferred from a seat 23 of the assembling drum 21 to a seat 34 of the assembling drum 32. A coupling station S7 is provided which is arranged downstream of the transfer station S6 relative to the rotation direction of the assembling drum 32 and in which a conductor element 10 is coupled to a support 9 carried by a seat 34 of the assembling drum 32.

Furthermore, the initial part A comprises a transfer drum 35 which is mounted rotatable around a rotation axis 36 parallel to the rotation axis 22 so as to rotate with intermittent motion (i.e. in a stepwise manner by cyclically alternating motion steps and still steps) around the rotation axis 36. The transfer drum 35 has a plurality of seats 37 each designed to house a support 9 of a heating device 6 (provided with a tube 12). The transfer drum 35 is tangent to the assembling drum 32 in a transfer station S8 where, when both the drums 32 and 35 are standing still, a support 9 is transferred from a seat 34 of the assembling drum 32 to a seat 37 of the transfer drum 35.

The initial part A comprises an assembling drum 38 which is mounted rotatable around a rotation axis 39 parallel to the rotation axis 22 so as to rotate with intermittent motion (i.e. in a stepwise manner by cyclically alternating motion steps and still steps) around the rotation axis 39. The assembling drum 38 has a plurality of seats 40 each designed to house a support 9 of a heating device 6 (provided with a tube 12). The assembling drum 38 is tangent to the transfer drum 35 in a transfer station S9 (arranged downstream of the transfer station S8 relative to the rotation direction of the transfer drum 35) in which, when both drums 35 and 38 are standing still, a support 9 is transferred from a seat 37 of the transfer drum 35 to a seat 40 of the assembling drum 38. A coupling station S10 is provided which is arranged downstream of the transfer station S9 relative to the rotation direction of the assembling drum 38 and in which a further (second) conductor element 10 is coupled to a support 9 carried by the seat 40 of the assembling drum 38. Finally, a transfer station S11 is provided which is arranged downstream of the coupling station S10 relative to the rotation direction of the assembling drum 38 and in which a support 9 of a heating device 6 (provided with a tube 12 and two conductor elements 10) leaves a seat 40 of the assembling drum 38 when the assembling drum 38 is standing still.

The initial part A comprises a feeding device 41 which moves, through the coupling stations S7 and S10, a sheet metal band 42 supporting a plurality of conductor elements 10. In particular, in the coupling station S7 the sheet metal band 42 partially wraps around the assembling drum 32 and in the coupling station S10 the sheet metal band 42 partially wraps around the assembling drum 38. A coupling device 43 is arranged in the coupling station S7, which picks up a conductor element 10 from the sheet metal band 42 and inserts the conductor element 10 into a support 9 carried by a seat 34 of the assembling drum 32; similarly, a coupling device 44 is arranged in the coupling station S10, which picks up a conductor element 10 from the sheet metal band 42 and inserts the conductor element 10 into a support 9 carried by a seat 40 of the assembling drum 38.

Figure 8:
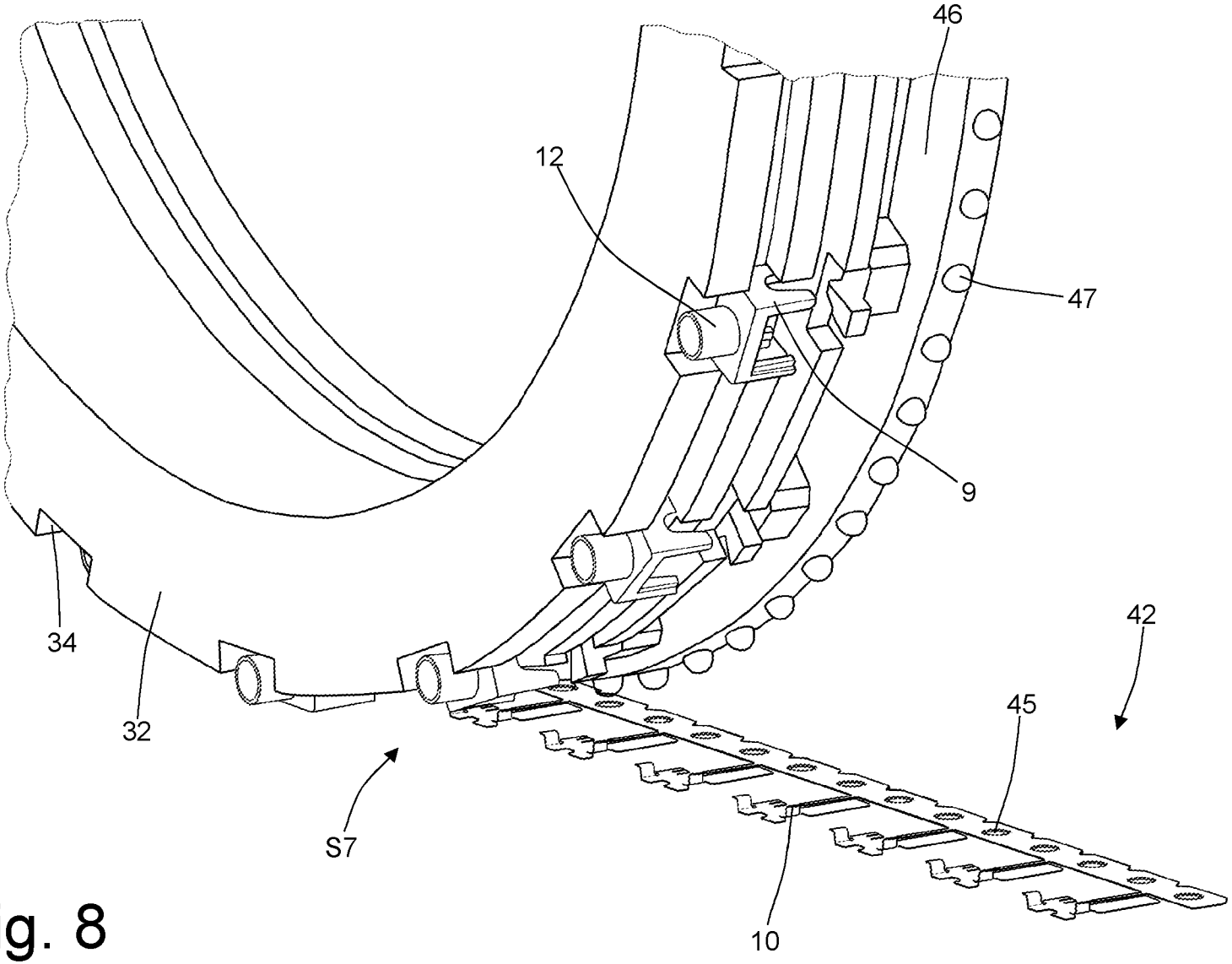
FIG. 8 is a view, on an enlarged scale, of a further assembling drum of the initial part of FIG. 6.

As better illustrated in FIG. 8, the sheet metal band 42 has a succession of through guide holes 45; the moving device 41 comprises two toothed guide drums 46 having a plurality of teeth 47 each designed to engage a corresponding guide hole 45 of the sheet metal band 42. As illustrated in FIG. 6, a guide drum 46 is coaxial to the assembling drum 32, is arranged beside the assembling drum 32, and rotates in a synchronous manner with the assembling drum 32; similarly, the other guide drum 46 is coaxial to the assembling drum 38, is arranged beside the assembling drum 38, and rotates in a synchronous manner with the assembling drum 38. The guide drums 46 guide the movement of the sheet metal band 42 by engaging the guide holes 45 of the sheet metal band 42 with its teeth 47; the function of the toothed guide drums 46 is to ensure perfect spatial synchronization between the conductor elements 10, formed in the sheet metal band 42, and the coupling devices 44. According to a preferred embodiment illustrated in the attached figures, the through guide holes 45 formed in an edge of the sheet metal band 42 are circular and the teeth 47 of the toothed guide drums 46 have a hemispherical shape; in this way, the teeth 47 of the toothed guide drums 46 are "self-centring" inside the through guide holes 45 formed in the edge of the sheet metal band 42.

According to a possible embodiment, the sheet metal band 42 is initially completely smooth and a machining device is provided upstream of the coupling station S7, which cyclically performs a cut of the sheet metal band 42 in order to obtain the conductor elements 10 in the sheet metal band 42 leaving a part of each conductor element 10 in contact with the remaining part of sheet metal band 42 (i.e. in contact with an edge of the sheet metal band 42). In other words, the machining device cyclically performs a cold-working of the sheet metal band 42 which consists of a separation of a defined geometry by using a punch and a die suitably designed and inserted in a more complex structure that defines a mould. According to a preferred embodiment, the punch and the die of the machining device are shaped to also perform a shaping of the sheet metal band so that some parts of each conductor element 10 are bent (as illustrated in detail in FIG. 8); in other words, the machining device also bends some parts of each conductor element 10 to give the conductor element 10 a desired shape (as illustrated in detail in FIG. 8).

According to a possible embodiment, when the machining device forms the guide holes 45 in an edge of the sheet metal band 42, it also forms through cuts which are arranged transversely and have the function of increasing the flexibility of the sheet metal band 42 so as to facilitate the subsequent handling thereof; the through cuts are generally aligned with the guide holes 45 and lead to the guide holes 45, but alternatively the through cuts (or at least part of them) may not be aligned with the guide holes 45 and/or may not lead to the guide holes 45.

Downstream of the coupling stations S7 and S10, what remains of the sheet metal band 42 is treated in a shredder device to be shredded and then subsequently collected and removed (and completely recycled).

As illustrated in FIG. 6, at the coupling station S7, the moving device 41 moves the sheet metal band 42 so as to arrange a conductor element 10 of the sheet metal band 42 radially aligned with a support 9 carried by a seat 34 of the assembling drum 32; the coupling device 43 comprises a thrust element 48 which performs a radially-oriented work stroke to push, in the coupling station S7, a conductor element 10 from the sheet metal band 42 to the support 9 carried by the seat 34 of the assembling drum 32.

According to a preferred embodiment, the coupling device 43 comprises a thrust drum 49 which is mounted rotatable around a rotation axis 50 parallel to the rotation axis 33, supports the thrust element 48, and is tangent to the assembling drum 32 at the coupling station S7.

According to a preferred embodiment, in the coupling station S7, the coupling device 43, by pushing a conductor element 10, causes a cut of the sheet metal band 42 at the joining area of the conductor element 10 with the rest of the sheet metal band 42. Furthermore, according to a preferred embodiment, in the coupling station S7 the coupling device 43 is designed to bend a conductor element 10 by inserting the conductor element 10 into a support 9 carried by a seat 34 of the assembling drum 32. Similarly, at the coupling station S10, the moving device 41 moves the sheet metal band 42 so as to arrange a conductor element 10 of the sheet metal band 42 radially aligned with a support 9 carried by a seat 40 of the assembling drum 38; the coupling device 44 comprises a thrust element 51 which performs a radially-oriented work stroke to push, in the coupling station S10, a conductor element 10 from the sheet metal band 42 to the support 9 carried by the seat 40 of the assembling drum 38.

According to a preferred embodiment, the coupling device 44 is completely similar to the coupling device 43 and comprises a thrust drum 52 which is mounted rotatable around a rotation axis 53 parallel to the rotation axis 39, supports the thrust element 51, and is tangent to the assembling drum 38 at the coupling station S10.

According to a preferred embodiment, in the coupling station S10 the coupling device 44, by pushing a conductor element 10, causes a cutting of the sheet metal band 42 at the joining area of the conductor element 10 with the rest of the sheet metal band 42. Furthermore, according to a preferred embodiment, in the coupling station S10 the coupling device 44 is designed to bend a conductor element 10 by inserting the conductor element 10 into a support 9 carried by a seat 40 of the assembling drum 38.

According to a possible embodiment, a welding station S12 is provided which is arranged along the assembling drum 32 between the coupling station S7 and the transfer station S8 (i.e. it is arranged downstream of the coupling station S7 relative to the rotation direction of the assembling drum 32) and is provided with a welding device 54 which connects, by means of welding, a conductor element 10 to a support 9 carried by a seat 34 of the assembling drum 32 standing still. Similarly, according to a possible embodiment, a welding station S13 is provided, which is arranged along the assembling drum 38 between the coupling station S10 and the transfer station S11 (i.e. it is arranged downstream of the coupling station S10 relative to the rotation direction of the assembling drum 38) and is provided with a welding device 55 which connects, by means of welding, a conductor element 10 to a support 9 carried by a seat 40 of the assembling drum 38 standing still.

Figure 9:
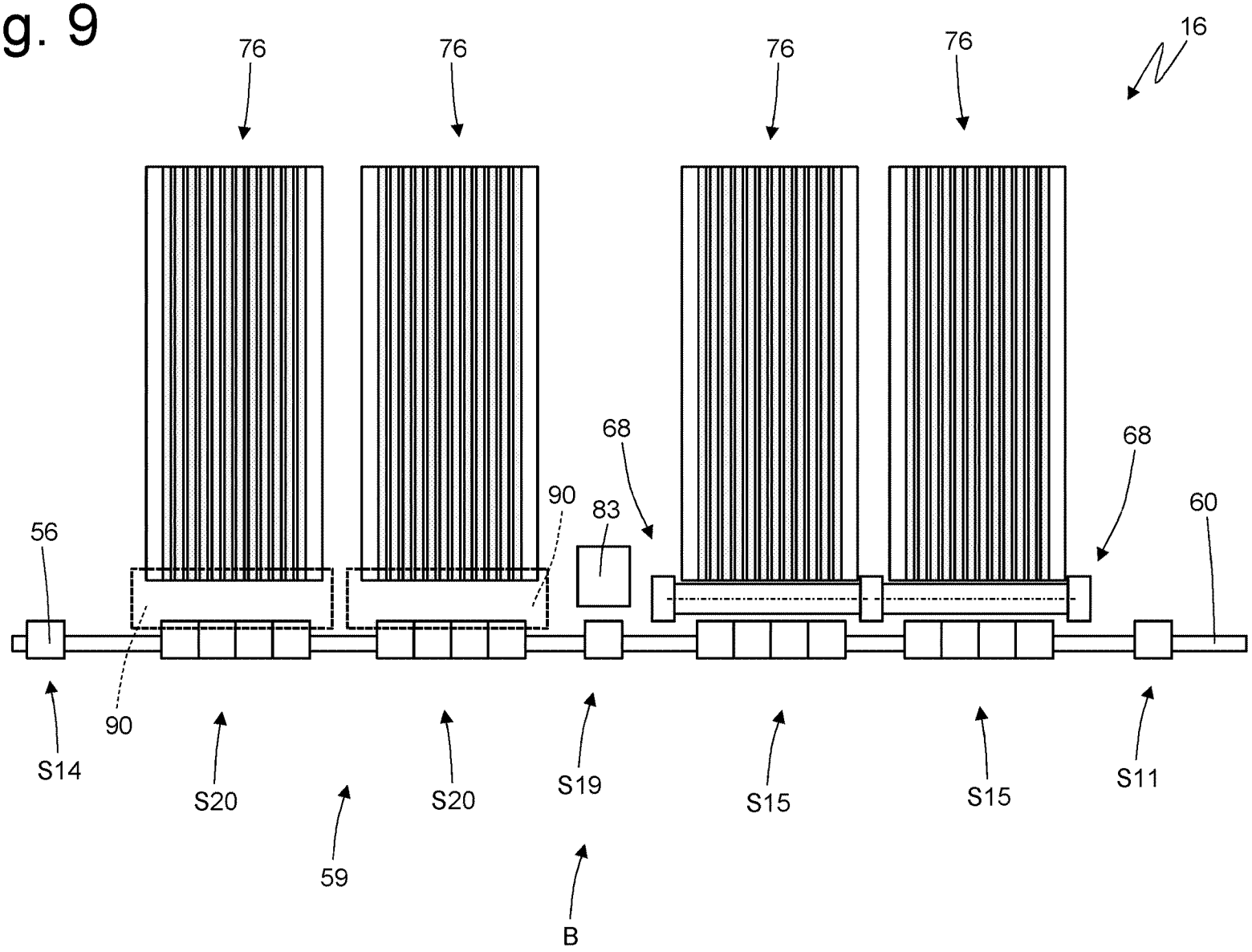
FIG. 9 is a plan view of an intermediate part of the manufacturing machine of FIG. 4.
Figure 10:
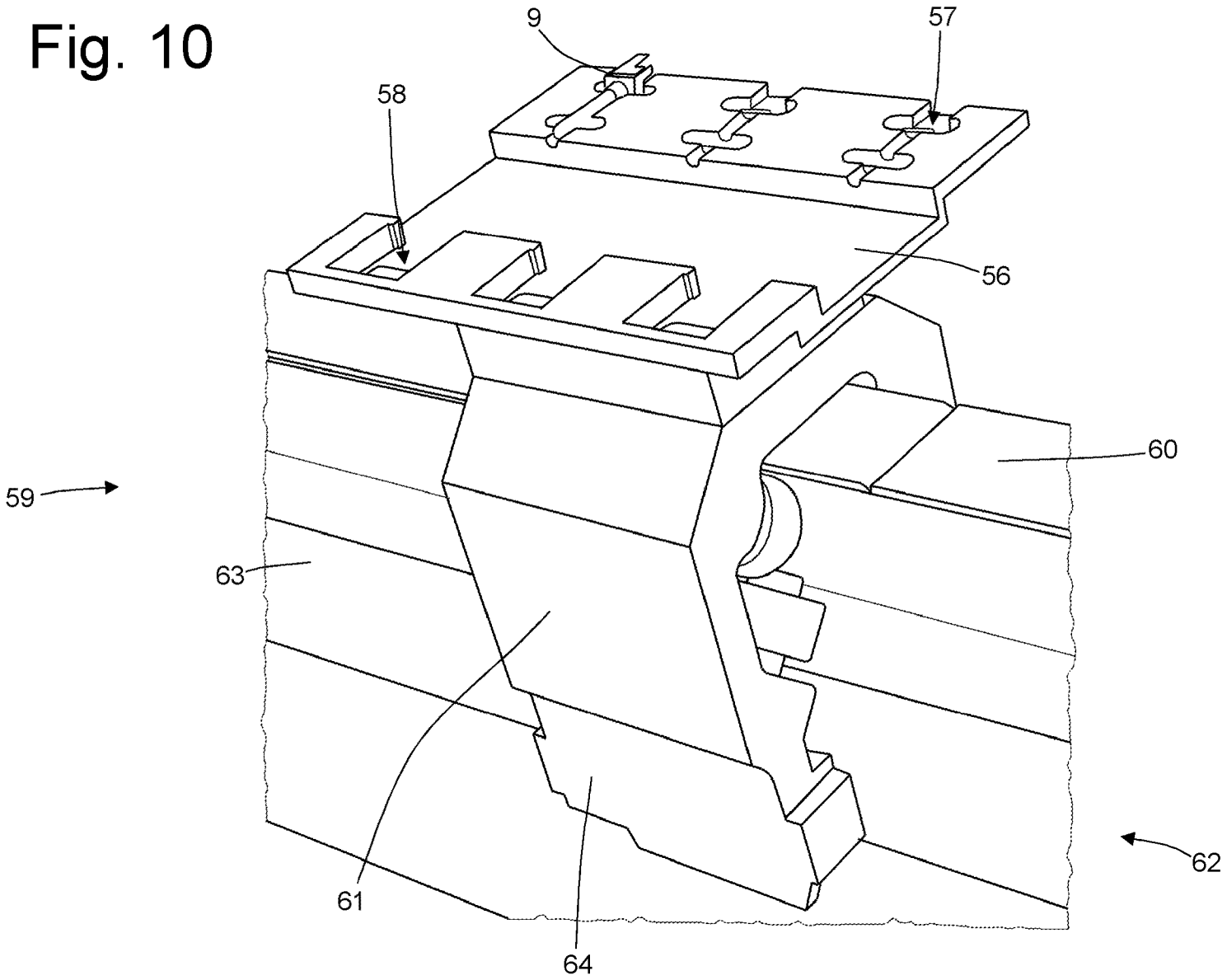
FIG. 10 is a perspective and schematic view of a movable plate of an assembling conveyor of the intermediate part of FIG. 9.

As illustrated in FIGS. 9 and 10, the intermediate part B of the manufacturing machine 15 comprises a plurality of movable plates 56 in each of which three seats 57 are provided, each designed to house a support 9 of a heating device 6 and three seats 58, each of which is axially aligned with a corresponding seat 57 and is designed to house a mouthpiece 13. In the embodiment illustrated in the attached figures, each movable plate 56 has three seats 57 and three corresponding seats 58; according to other embodiments not illustrated, each movable plate 56 has a different number of seats 57 and 58 (generally from a minimum of one seat 57 and one seat 58 to a maximum of six/eight seats 57 and corresponding six/eight seats 58). The intermediate part B of the manufacturing machine 15 comprises an assembling conveyor 59 to cyclically move each movable plate 56 along an annular assembling path with an intermittent (stepwise) movement which provides for cyclically alternate motion steps in which the assembling conveyor 59 moves the movable plates 56 and still steps in which the assembling conveyor 59 keeps the movable plates 56 standing still.

The assembling path comprises a straight operating segment which extends from the transfer station S11 (which forms the end of the initial part A and the beginning of the intermediate part B) in which the supports 9 of the heating devices 6 (provided with the tubes 12 and with the conductor elements 10) are cyclically fed from the seats 40 of the assembling drum 38 to the seats 57 of the movable plates 56 to a transfer station S14 (which forms the end of the intermediate part B and the beginning of the final part C) in which the supports 9 of the heating devices 6 (to which the wicks 7 provided with the electrical coils 8 have been added) leave the seats 57 of the movable plates 56 and the mouthpieces 13 (provided with the absorbent pads 14) leave the seats 58 of the movable plates 56. Furthermore, as illustrated in FIG. 5, the assembling path comprises a straight return segment parallel and opposite to the straight operating segment and two semi-circular joining segments that connect the operating segment and the return segment to one another.

As illustrated in FIG. 10, the assembling conveyor 59 comprises an annular guide 60 (i.e. closed in a loop on itself) which is arranged in a fixed position along the assembling path; in particular, the annular guide 60 is formed by a single fixed track (i.e. motionless) which is arranged along the assembling path. Furthermore, the assembling conveyor 59 comprises a plurality of slides 61, each of which supports a corresponding movable plate 56 and is coupled to the guide 60 so as to freely slide along the guide 60. Finally, the assembling conveyor 59 comprises a linear electric motor 62 which moves the slides 61 carrying the movable plates 56 along the assembling path; the linear electric motor 62 comprises an annular stator 63 (i.e. a fixed primary) which is arranged in a fixed position along the guide 60 and a plurality of movable sliders 64 (i.e. mobile secondaries), each of which is electro-magnetically coupled to the stator 63 to receive a driving force from the stator 63 and is rigidly connected to a corresponding slide 61.

The stator 63 of the linear electric motor 62 comprises a ferromagnetic armature having a series of slots housing the coils designed to be crossed by time-varying electric currents to generate corresponding stator magnetic fields (time-varying); each slider 64 of the linear electric motor 62 comprises a ferromagnetic armature in which at least one permanent magnet is arranged, which generates a rotor magnetic field (constant over time) that interacts with the stator magnetic field to generate a driving force, having an electromagnetic origin, on the slider 64. In each slide 61, the slider 64 is mounted so as to be in close proximity (indicatively 1-2 millimetres) to the stator 63 to minimize the air gap existing between the ferromagnetic armature of the slider 64 and the ferromagnetic armature of the stator 63.

A control device is provided which drives the linear electric motor 62 by applying a variable voltage to the coils of the stator 63. Preferably, the control device uses a closed chain control system (i.e. in feedback) to control the position of each slider 64 (therefore of each slide 61). Consequently, the control device must know in real-time and with good precision the actual position of each slider 64 (therefore of each slide 61) along the assembling path; for this purpose, the control device can reconstruct the actual position of each slider 64 along the assembling path by means of estimation algorithms based on the electrical signals present at the ends of the coils of the stator 63 or the control device can receive the detection from a special position sensor which is arranged along the assembling path. For example, the position sensor comprises a measuring ring made of magnetostrictive material which is arranged along the assembling path and, for each slider 64, a corresponding permanent magnet which is arranged in proximity of the measuring ring.

According to a different embodiment not illustrated, the assembling conveyor 59 is a belt conveyor and comprises (at least) a flexible band which supports the movable plates 56 and is closed in a loop around two end pulleys (at least one of which is motorized).

As illustrated in FIG. 9, along the assembling path (i.e. between the transfer station S11 and the transfer station S14) two twin feeding stations S15 (i.e. substantially identical) are arranged in succession (i.e. one after the other) and completely independent of each other. The two feeding stations S15 are obviously arranged downstream of the transfer station S11 relative to the feeding direction of the assembling conveyor 58, are completely autonomous one relative to the other, and differ from one another only for the different position, i.e. one feeding station S15 is arranged upstream of the other feeding station S15 relative to the movement direction of the assembling conveyor 59. In each feeding station S15 the wicks 7 provided with respective electrical coils 8 are coupled to corresponding supports 9 carried by the seats 57 of several movable plates 56 standing still; in particular, in the embodiment illustrated in the attached figures, in each feeding station S15 simultaneously twelve wicks 7 provided with respective electrical coils 8 are coupled to twelve corresponding supports 9 carried by the twelve seats 57 of four movable plates 56 arranged side by side (as better illustrated in FIG. 11).

According to a possible embodiment, the two feeding stations S15 operate in parallel, i.e. both feeding stations S15 are working simultaneously so as to halve the operating speed of each feeding station S15 relative to the operating speed of the manufacturing machine 15. According to an alternative embodiment, the two feeding stations S15 are redundant and only one feeding station S15 is used at a time while the other feeding station S15 is standing still and therefore can be maintained and/or supplied even when the manufacturing machine 15 is working. According to a different embodiment not illustrated, only one single feeding station S15 is provided instead of two twin and subsequent feeding stations S15.

Figure 12:
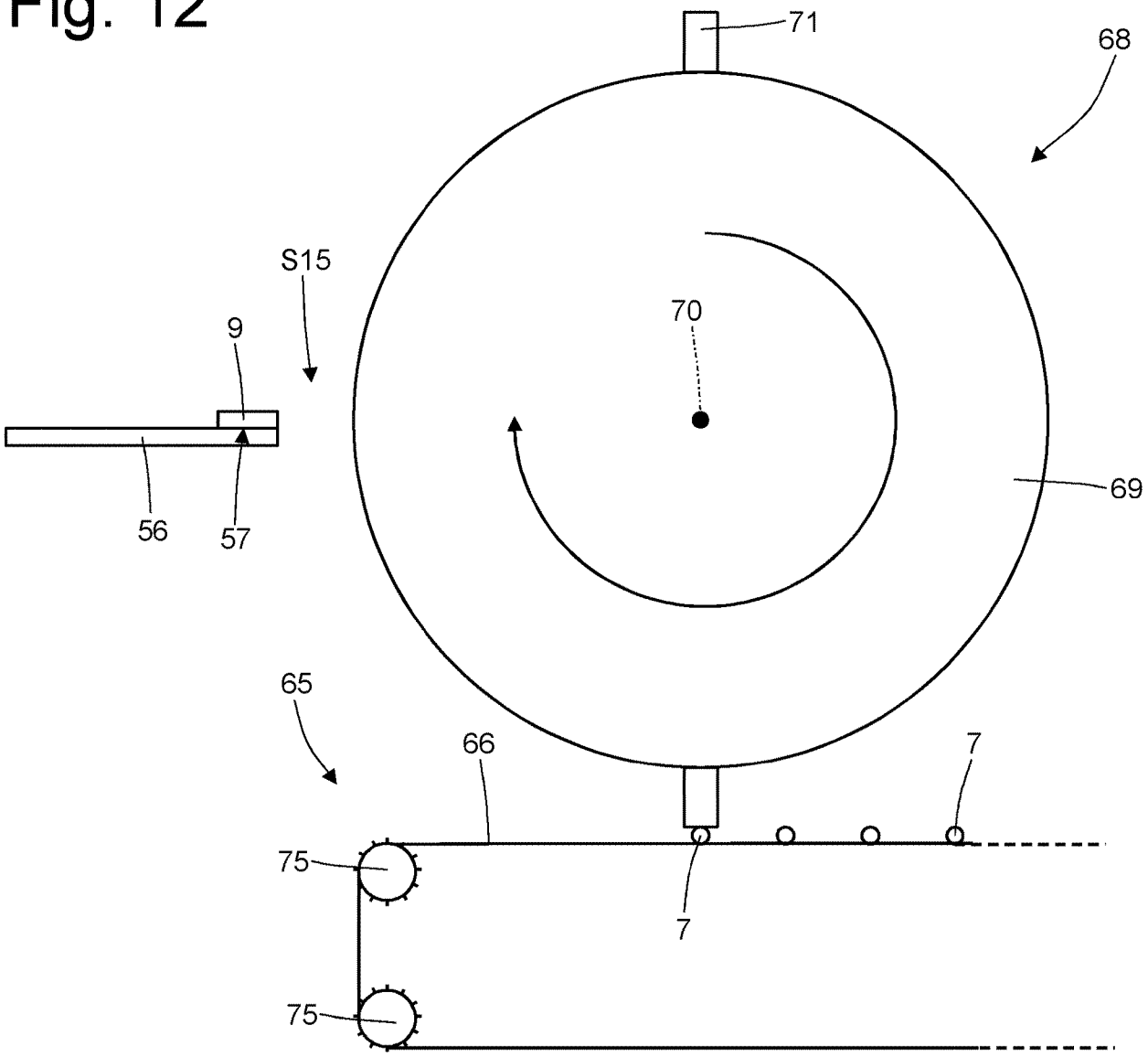
FIGS. 12 and 13 are two lateral and schematic views of the feeding station of FIG. 11 in two different operating moments.
Figure 13:
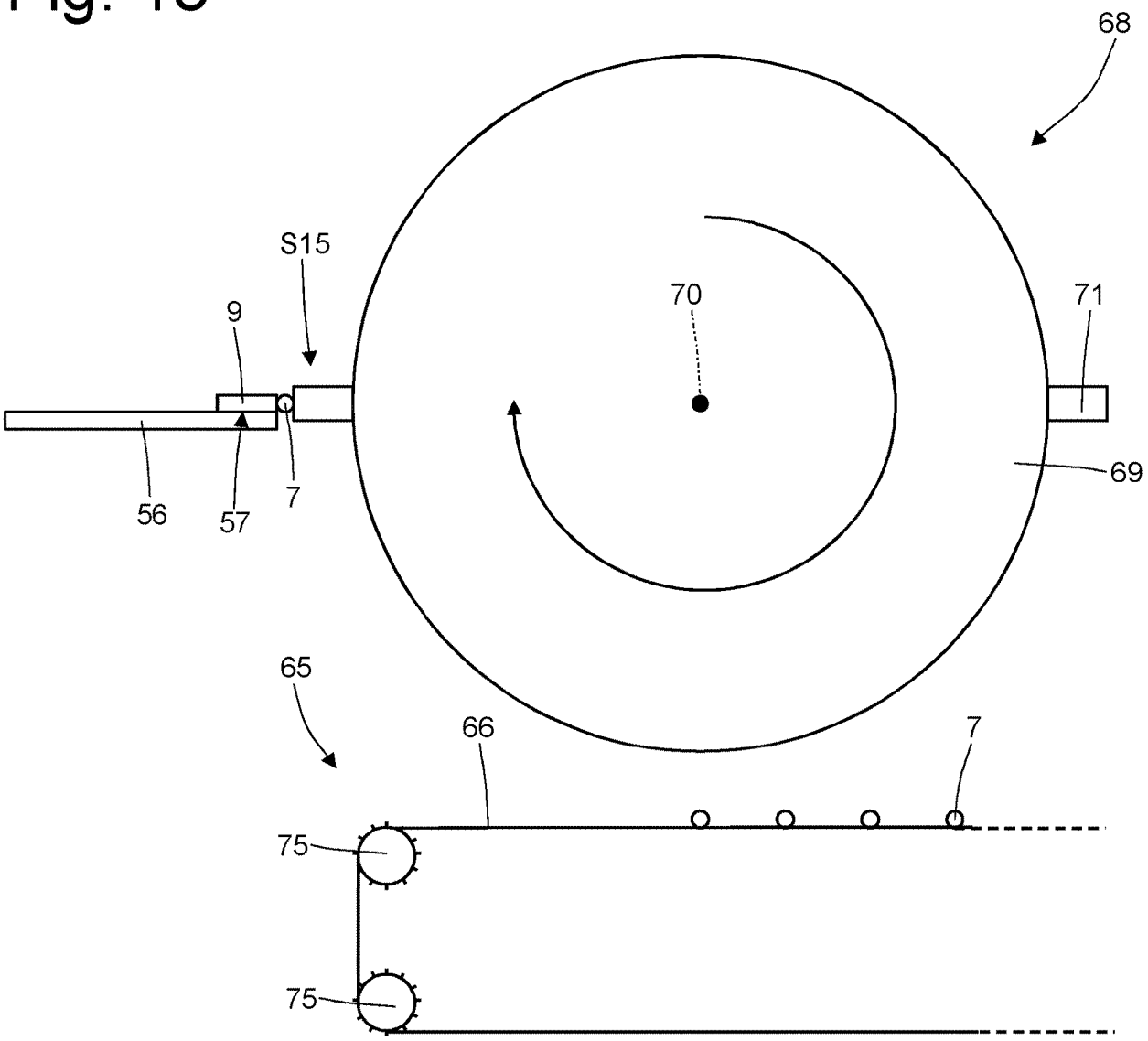
Figure 14:
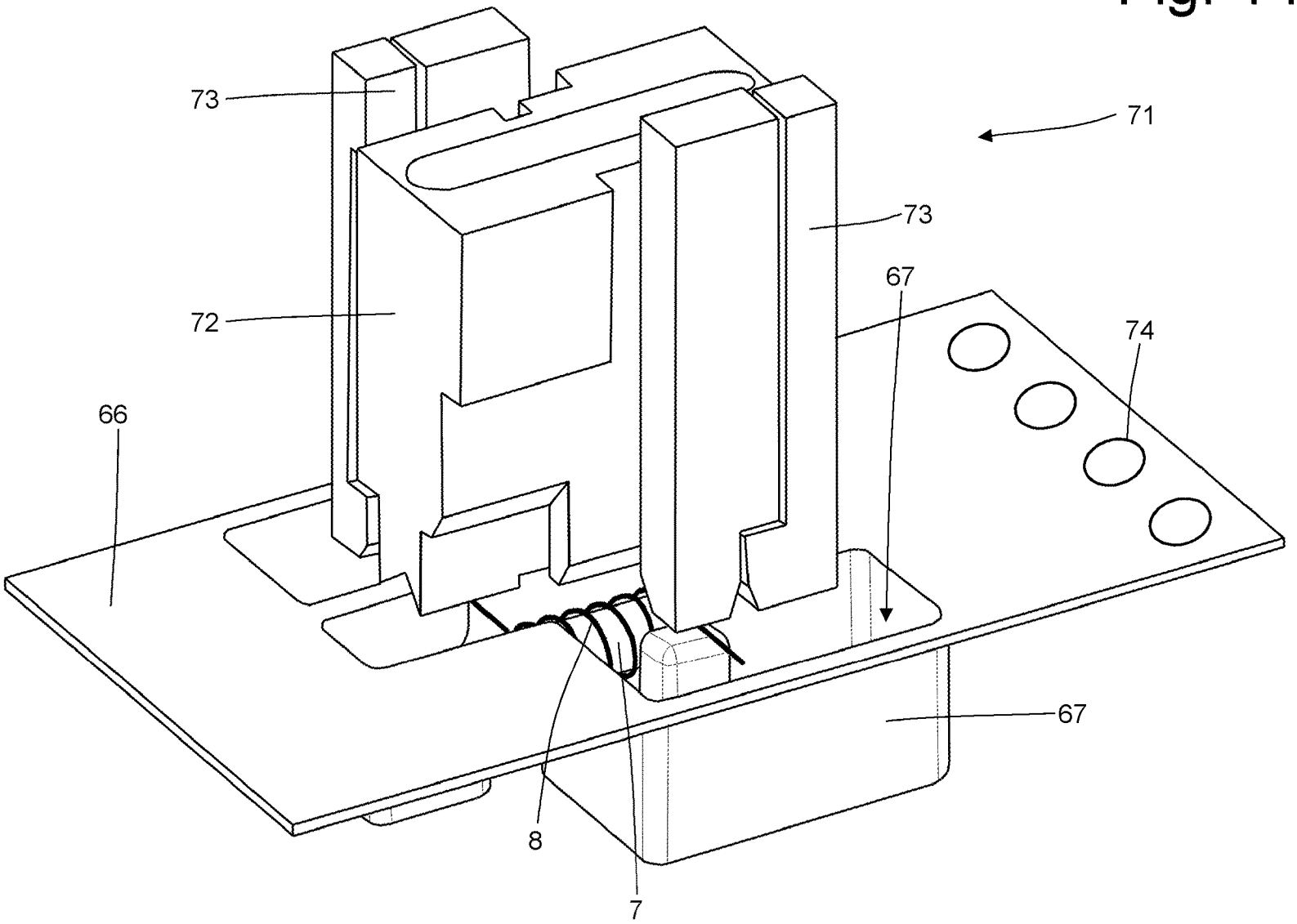
FIG. 14 is a perspective and schematic view of the removal of a wick in the feeding station of FIG. 11.

As illustrated in FIGS. 12 and 13, in each feeding station S15 a moving device 65 is provided which moves, through the feeding station S15, a plurality of bands 66 (in particular twelve bands 66) parallel to one another and beside one another and each provided with a plurality of absorbent pockets 67 (one of which is illustrated in FIG. 14) in which respective wicks 7 are housed, each provided with an electrical coil 8.

Furthermore, according to what is illustrated in FIGS. 12 and 13, in each feeding station S15 a feeding device 68 is provided, which picks up a plurality of wicks 7 (in particular twelve wicks 7 in the embodiment illustrated in the attached figures) each provided with an electrical coil 8 from as many pockets 67 of the twelve bands 66 and inserts each wick 7 provided with an electrical coil 8 into a support 9 carried by a corresponding seat 57 of a movable plate 56 standing still in the feeding station S15.

Figure 11:
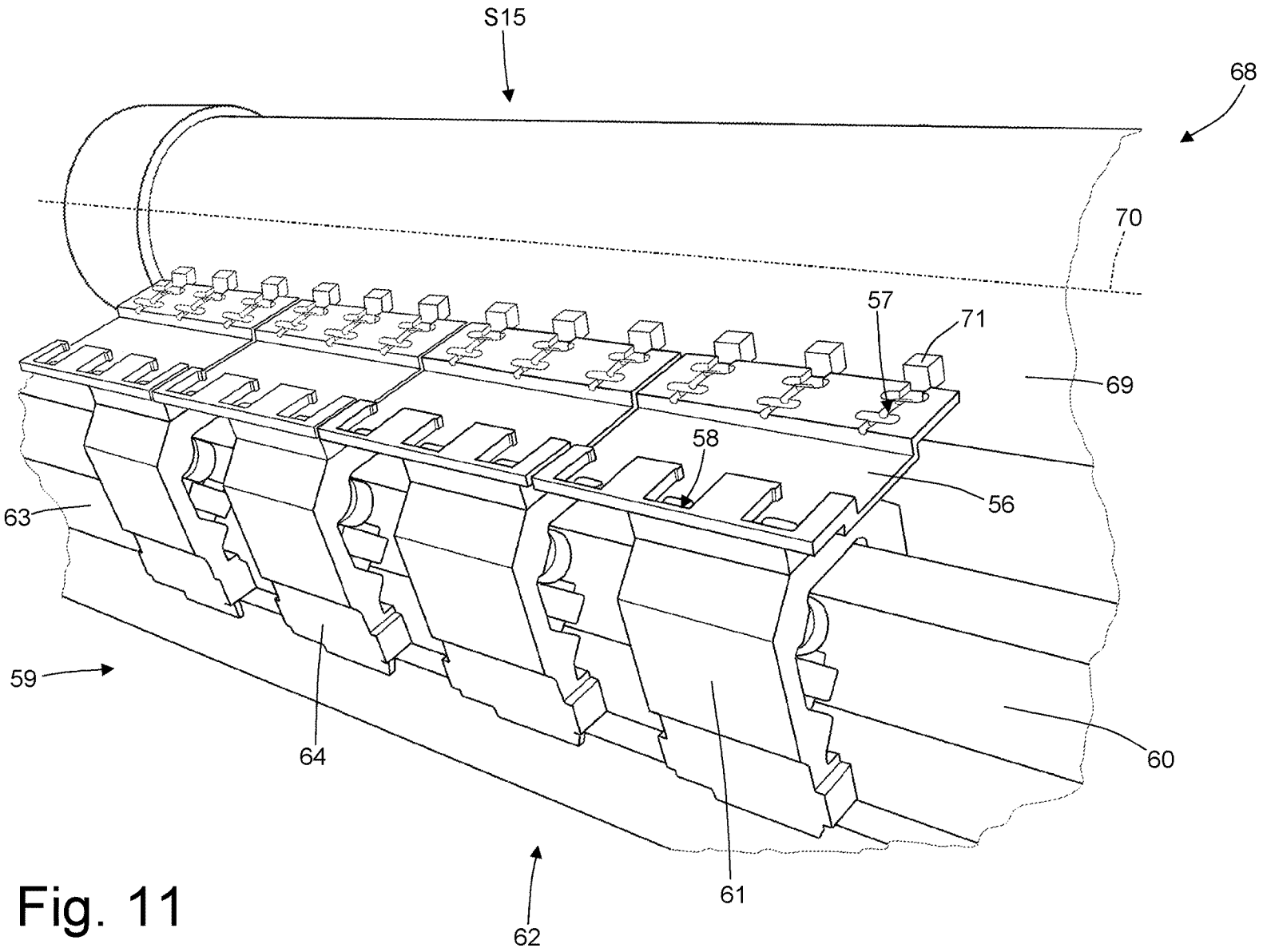
FIG. 11 is a perspective and schematic view of a wick feeding station of the intermediate part of FIG. 9.

As illustrated in FIGS. 11, 12 and 13, each feeding device 68 comprises a feeding drum 69 which is mounted rotatable around a horizontal rotation axis 70 so as to rotate with intermittent motion (i.e. in a stepwise manner by cyclically alternating motion steps and still steps) around the rotation axis 70. Each feeding drum 69 has a plurality of groups of gripping heads 71 each designed to house a wick 7 provided with an electrical coil 8; in particular, in the embodiment illustrated in the attached figures, each feeding drum 69 has two groups of gripping heads 71 which are arranged at 180° from one another and each have twelve gripping heads 71 aligned with one another parallel to the rotation axis 70. Consequently, each group of (twelve) gripping heads 71 is designed to pick up twelve wicks 7 from the pockets 67 of as many tapes 66 and is subsequently designed to insert the twelve wicks 7 into twelve supports 9 carried by twelve seats 57 of four movable plates 56 standing still in the feeding station S15. In use, the rotation of the feeding drum 69 around the rotation axis 70 cyclically brings each group of (twelve) heads 71 firstly, to a pick up position, near the (twelve) bands 66 to pick up (twelve) wicks 7 each provided with an electrical coil 8 from as many pockets 67 of the (twelve) bands 66 (as illustrated in FIG. 12) and then brings each group of (twelve) gripping heads 71 into a release position in proximity of the four movable plates 56 standing still in the feeding station S15 so as to insert the (twelve) wicks 7 in as many supports 9 carried by the (twelve) seats 57 of the four movable plates 56 (as illustrated in FIGS. 11 and 13).

Figure 15:
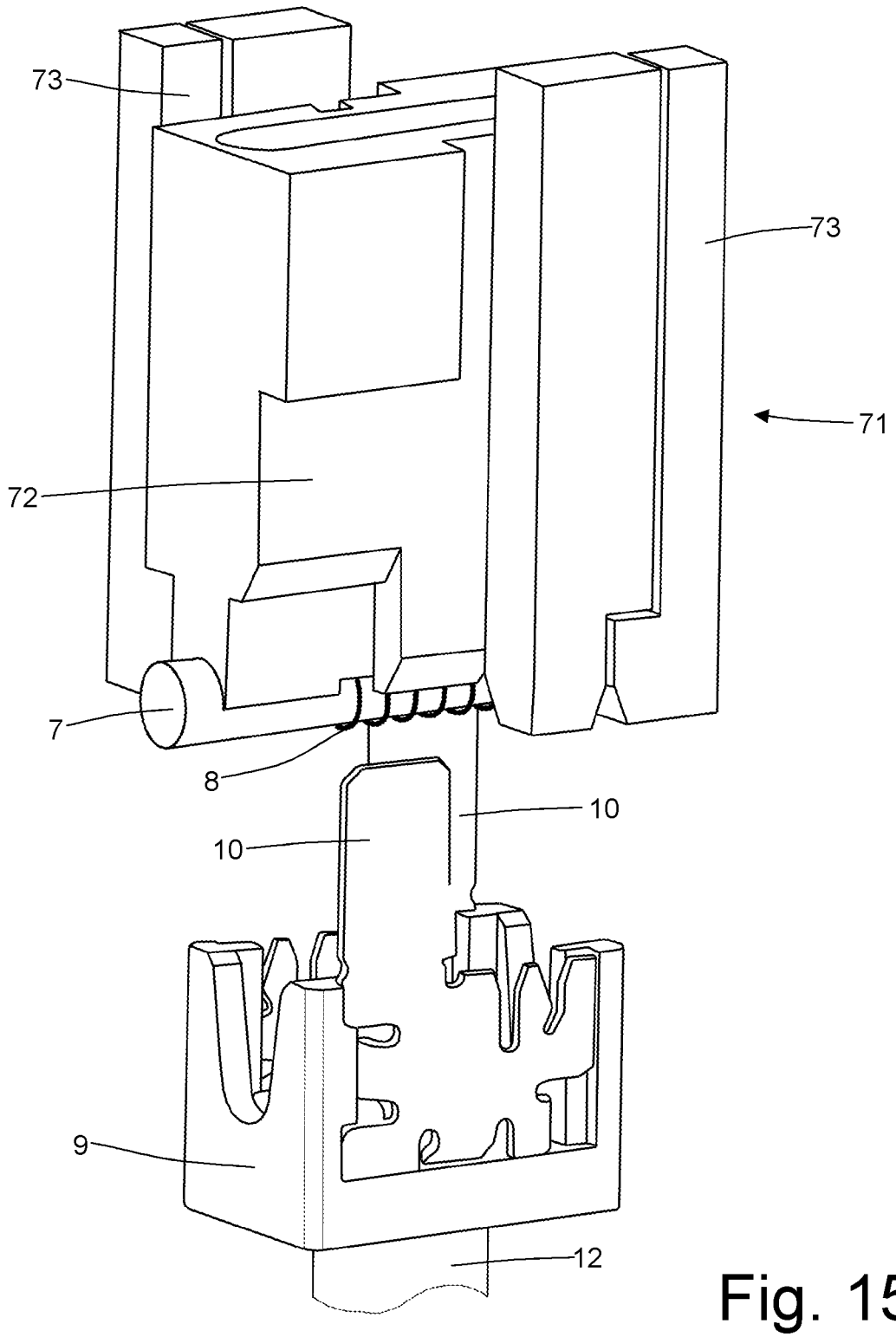
FIG. 15 is a perspective and schematic view of the transfer of a wick in the feeding station of FIG. 11.

As illustrated in FIGS. 14 and 15, each gripping head 71 has a main body 72 (typically sucking) that is centrally arranged and is designed to engage a wick 7 provided with an electrical coil 8, and with two side bodies 73 which are arranged on opposite sides of the main body 72 are movable relative to the main body 72 along radial directions relative to the rotation axis 70 of the feeding drum 68, and are designed to engage two ends of the electrical coil 8; in particular, each side body 73 has a slit (initially having a flared "funnel-like" shape to be self-centring) in which one end of the electrical coil 8 is inserted.

As illustrated in FIG. 14, when a gripping head 71 picks up a wick 7 provided with an electrical coil 8 from a pocket 67 of the tape 66, initially the main body 72 of the gripping head 71 engages the wick 7 while the two side bodies 73 of the gripping head 71 are at a given distance (other than zero) from the two ends of the electrical coil 8; subsequently the two side bodies 73 of the gripping head 71 make a movement relative to the main body 72 so as to engage the two ends of the electrical coil 8 after the wick 7 has already been previously engaged by the main body 72.

As illustrated in FIG. 15, when a gripping head 71 couples a wick 7, provided with an electrical coil 8, with a support 9 carried by a seat 57 of a movable plate 56 standing still in the feeding station S15, initially the main body 72 of the gripping head 71 rests and releases the wick 7 inside the support 9 and subsequently the two side bodies 73 of the gripping head 71 make a movement relative to the main body 72 so as to bend the two ends of the electrical coil by 90° against the support 9.

As illustrated in FIG. 14, each band 66 has a succession of through guide holes 74 which are used to move the band 66; for this purpose and according to what is illustrated in FIGS. 12 and 13, each moving device 65 has a plurality of toothed guide drums 75 having a plurality of teeth each designed to engage a corresponding guide hole 74 of the band 66.

Figure 16:
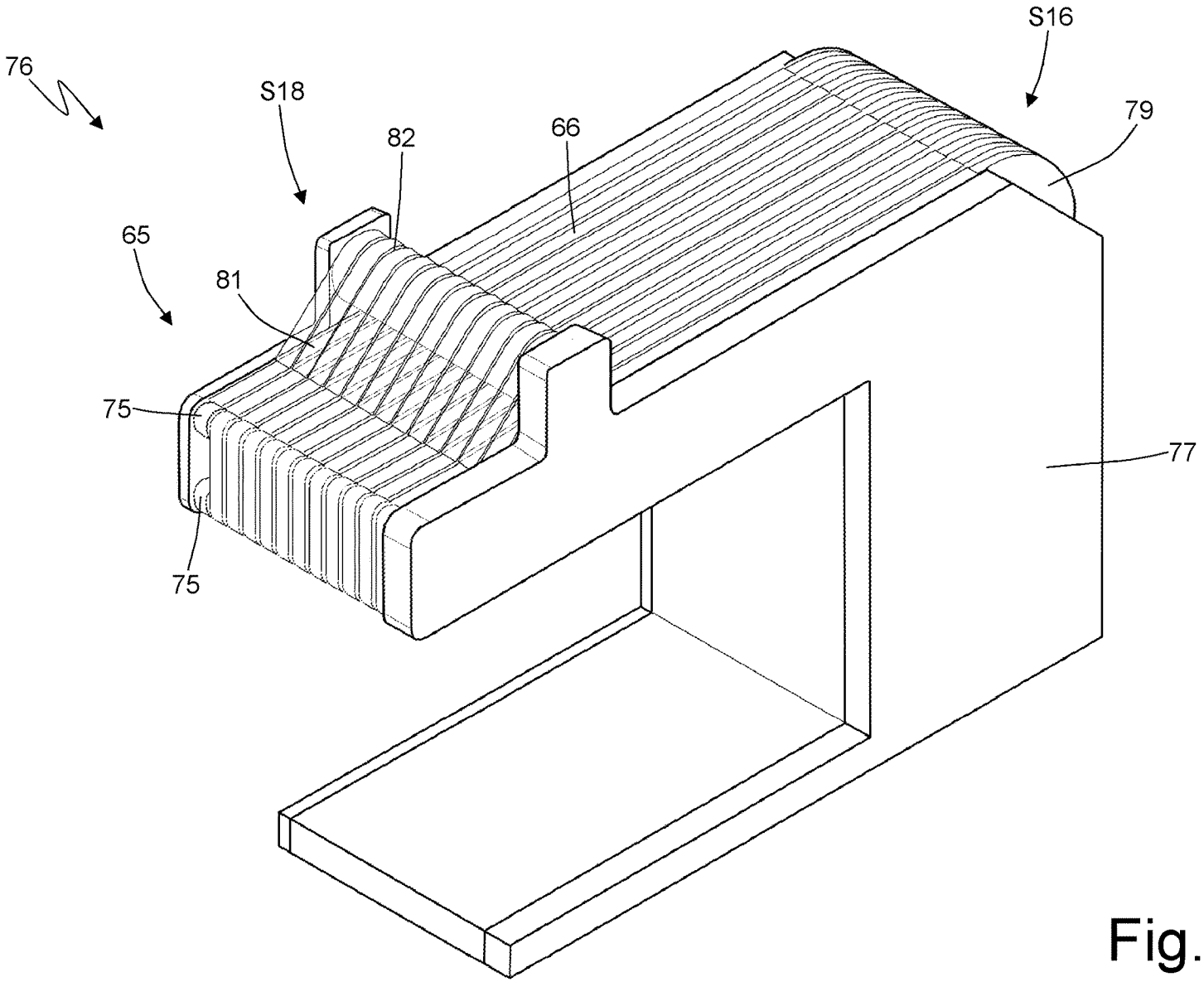
FIG. 16 is a perspective and schematic view of a feeding trolley of the feeding station of FIG. 11.
Figure 17:
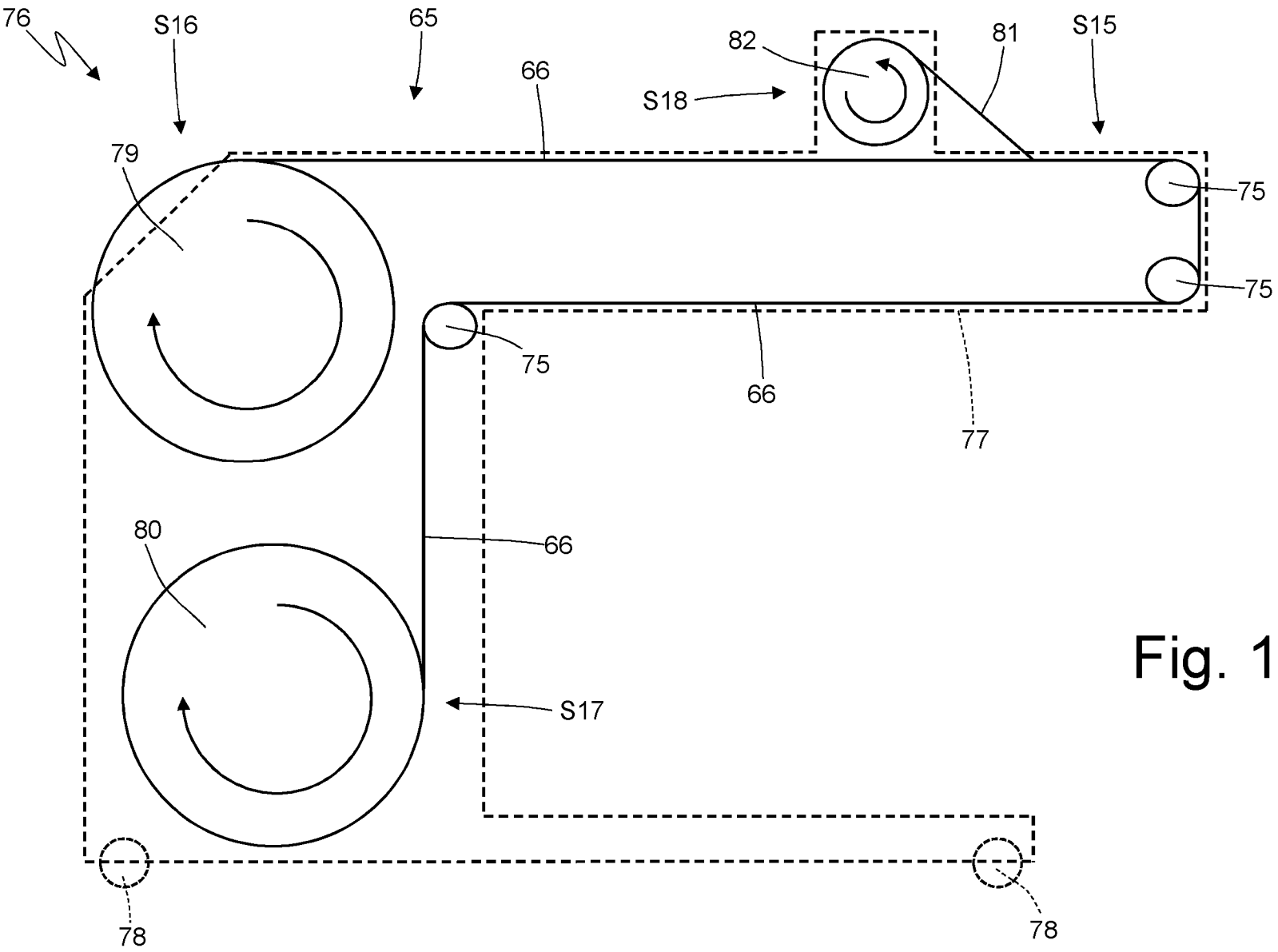
FIG. 17 is a lateral and schematic view of the feeding trolley of FIG. 16.

As illustrated in FIGS. 16 and 17, each moving device 65 is housed in a feeding trolley 76 which is independent from the rest of the assembling section 16 of the manufacturing machine 15, i.e. is designed to be separable (also in use) from the rest of the assembling section 16 of the manufacturing machine 15; in other words, each feeding trolley 76 is designed to be quickly inserted or uninserted from the rest of the assembling section 16 of the manufacturing machine 15. For this purpose, each feeding trolley 76 comprises its own frame 77 which is "C"-shaped and is provided with wheels 78 for sliding without friction on the floor on which the support body 18 of the assembling section 16 of the manufacturing machine 15 rests. The frame 77 of each feeding trolley 76 supports an unwinding station S16 which houses a plurality of reels 79 (in particular twelve reels 79) beside one another and parallel to one another in which a new band 66 is wound (i.e. the pockets 67 of which contain respective wicks 7 provided with electrical coils 8); moreover, the frame 77 of each feeding trolley 76 supports a winding station S17 which houses a plurality of reels 80 (in particular twelve reels 80) beside one another and parallel to one another inside of which a used band 66 is wound (i.e. the pockets 67 of which are empty and therefore no longer contain respective wicks 7 provided with electrical coils 8). In use, each of the twelve bands 66 is unwound from a reel 79 in the unwinding station S16, is passed through the feeding station S15 in which the wicks 7 provided with electrical coils 8 are picked up from the corresponding pockets 67, and finally is wound around a reel 80 in the winding station S17.

According to a preferred embodiment, each band 66 is provided with a protective film 81 (typically made of transparent plastic material) which closes the pockets 67 at the top and is separated from the band 66 (to reveal the pockets 67) immediately upstream of the feeding station 15; in particular, each protective film 81, after being separated from the tape 66, is wound in a reel 82 arranged in a winding station S18 (arranged above the tape 66).

FIG. 16 illustrates the twelve reels 79 from which twelve tapes 66 are unwound and the twelve reels 82 on which the twelve protective films 81 are wound.

When the two feeding stations S15 are used alternatively, in the feeding station S15, not used at that moment, the feeding trolley 76 can be decoupled from the assembling section 16 to remove the exhausted reel 79 and the full reels 79 and 80 and insert a new full reel 79 and new empty reels 79 and 80, i.e. to perform the renewal of the assembly materials.

In the embodiment illustrated in the attached figures, the two feeding trolleys 76 enter the assembling section 16 from the rear (i.e. from the opposite side of the front of the machine); according to an alternative embodiment, the two feeding trolleys 76 enter the assembling section 16 from the front (i.e. from the front of the machine).

Figure 18:
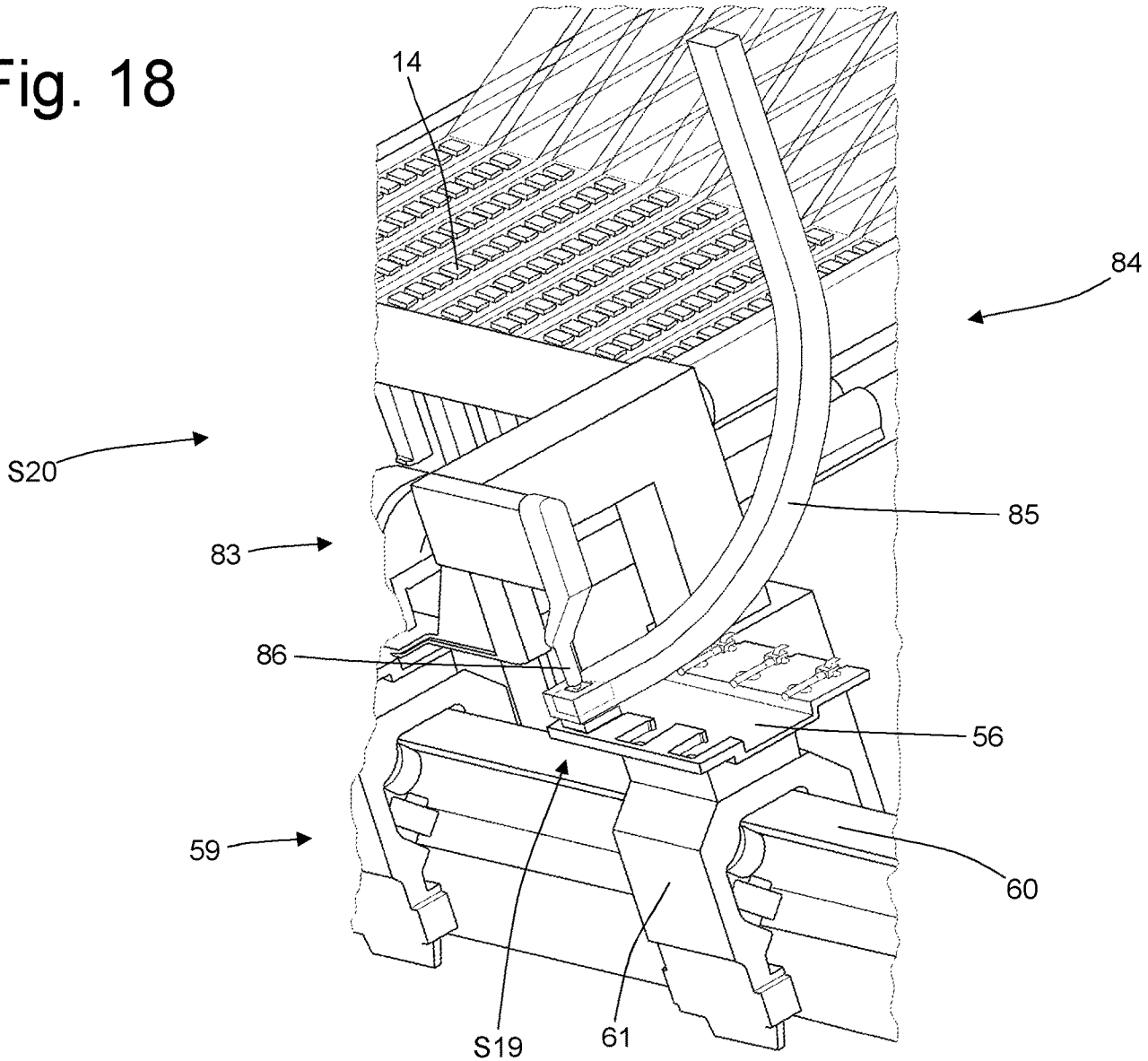
FIG. 18 is a perspective and schematic view of a mouthpiece feeding station of the intermediate part of FIG. 9.

As illustrated in FIG. 9, along the assembling path and downstream of the two feeding stations S15 relative to the movement direction of the assembling conveyor 59 a feeding station S19 is provided, in which a feeding device 83 is arranged, which feeds a mouthpiece 13 into a seat 58 of a movable plate 56 standing still. As illustrated in FIG. 18, the feeding device 83 comprises a feeding conveyor 84 provided with a channel 85 along which the mouthpieces 13 fall by gravity (pneumatic feeding could also possibly be provided); an intermediate portion of the channel 85 is vertical while a final portion of the channel 85 (at the feeding station S19 is horizontal and the two portions are connected by means of a curve). The final portion of the channel 85 is arranged above a seat 58 of a movable plate 56 standing still in the feeding station S19. At the end of the channel 85 a pusher 86 is arranged, which, by means of a vertical movement directed from top to bottom, pushes a mouthpiece 13 from the channel 85 to a seat 58 of a movable plate 56 standing still in the feeding station S19.

In the embodiment illustrated in the attached figures, only one mouthpiece 13 is fed in the feeding station S19 at a time, in a seat 58 of a movable plate 56 standing still; according to an alternative embodiment not illustrated, in the feeding station S19 several mouthpieces 13 are fed at a time (for example two or three mouthpieces 13 at a time) in as many seats 58 of a movable plate 56 standing still or possibly even several movable plates 56 standing still.

As illustrated in FIG. 9, along the assembling path and downstream of the feeding station S19 relative to the movement direction of the assembling conveyor 59, two twin coupling stations S20 (i.e. substantially identical to one another) are arranged in succession (i.e. one after the other) and completely independent of one another. The two coupling stations S20 are completely independent from one another, and differ from one another only in their different position, i.e. a coupling station S20 is arranged upstream of the other coupling station S20 relative to the movement direction of the assembling conveyor 59. In each feeding station S20 pairs of absorbent pads 14 are coupled to corresponding mouthpieces 13 carried by the seats 58 of several movable plates 56 standing still; in particular, in the embodiment illustrated in the attached figures, in each coupling station S20 simultaneously twelve pairs of absorbent pads 14 are coupled to twelve corresponding mouthpieces 13 carried by the twelve seats 58 of four movable plates 56 arranged beside one another (as better illustrated in FIG. 19). According to a possible embodiment, the two coupling stations S20 operate in parallel, i.e. both coupling stations S20 are working simultaneously so as to halve the operating speed of each coupling station S20 relative to the operating speed of the manufacturing machine 15. According to an alternative embodiment, the two coupling stations S20 are redundant and only one coupling station S20 is used at a time while the other coupling station S20 is standing still and therefore can be maintained and/or supplied even when the manufacturing machine 15 is operating. According to a different embodiment not illustrated, there is a single coupling station S20 is provided instead of two twin and subsequent coupling stations S20.

Figure 19:
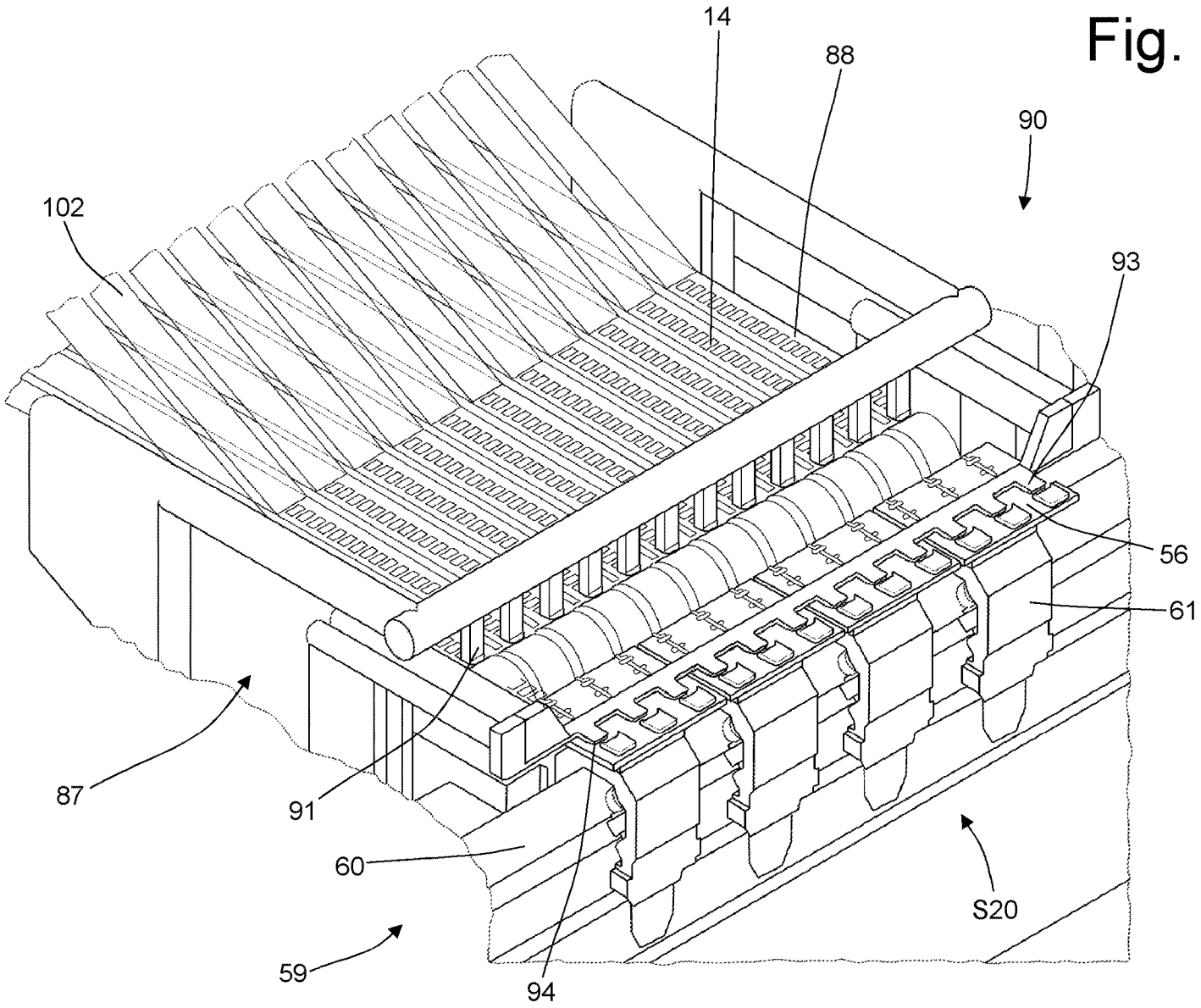
FIG. 19 is a perspective and schematic view of a station for feeding absorbent pads of the intermediate part of FIG. 9

As illustrated in FIG. 19, in each coupling station S20 a moving device 87 is provided, which moves, through the coupling station S20, a plurality of bands 88 (in particular twelve bands 88) parallel to one another and beside one another and each provided with a plurality of pockets 89 (better illustrated in FIGS. 20 and 21) housing respective absorbent pads 14. Furthermore, as illustrated in FIG. 19, in each coupling station S20 a feeding device 90 is arranged, which picks up a plurality of pairs of absorbent pads 14 (in particular twelve pairs of absorbent pads 14 in the embodiment illustrated in the attached figures) from as many pockets 89 of the twelve bands 88 and inserts each pair of absorbent pads 14 into a mouthpiece 13 carried by a corresponding seat 58 of a movable plate 56 standing still in the coupling station S20.

Each feeding device 90 comprises a plurality of suction gripping heads 91 (in particular twelve suction gripping heads 91) arranged beside one another and a handling device 92 which moves the plurality of (twelve) gripping heads 91 between a pick up position (illustrated in FIG. 22) in which the group of (twelve) gripping heads 91 is designed to pick up twelve absorbent pads 14 from the pockets 89 of as many bands 88 and a release position (illustrated in FIG. 23) in which the group of (twelve) gripping heads 91 is designed to rest twelve absorbent pads 14 in front of as many mouthpieces 13 carried by the (twelve) seats 58 of the four movable plates 56 standing still.

Each feeding device 90 comprises a pusher 93 (which is singular and common for all twelve seats 58 of the four movable plates 56 standing still in the coupling station S20) which is designed to push each absorbent pad 14 into a mouthpiece 13 carried by the corresponding seat 58 of a movable plate 56 standing still in the coupling station S20. Furthermore, each feeding device 90 comprises a support plane 94 (which is singular and common for all twelve seats 58 of the four movable plates 56 standing still in the coupling station S20) which is arranged in front of the mouthpieces 13 carried by the seats 58 of the four movable plates 56 standing still, is designed to receive twelve absorbent pads 14 from the twelve suction gripping heads 91, and is designed to cooperate with the corresponding pusher 93 which pushes the twelve absorbent pads 14 resting on the support plane 94 into as many twelve mouthpieces 13 carried by the seats 58 of the four movable plates 56 standing still in the coupling station S20.

As previously mentioned, each cartridge 1 comprises two absorbent pads 14 housed in the mouthpiece 13; consequently each feeding device 90 feeds two absorbent pads 14, in succession, into each mouthpiece 13 carried by a seat 58 of one of the four movable plates 56 standing still in the coupling station S20 by placing the support plane 94 at two different heights.

With reference to FIGS. 24-35, the feeding of two absorbent pads 14 into a mouthpiece 13 housed in a seat 58 of one of four movable plates 56 is described, as standing still in the coupling station S20.

Figure 24:
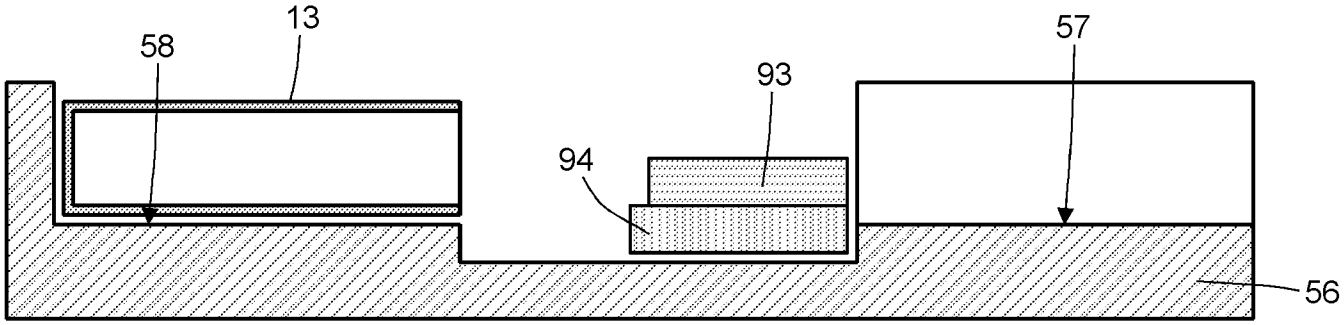
FIGS. 24-35 are a plurality of lateral and schematic views of a movable plate standing still in the feeding station of FIG. 19 and in different operating moments.
Figure 25:
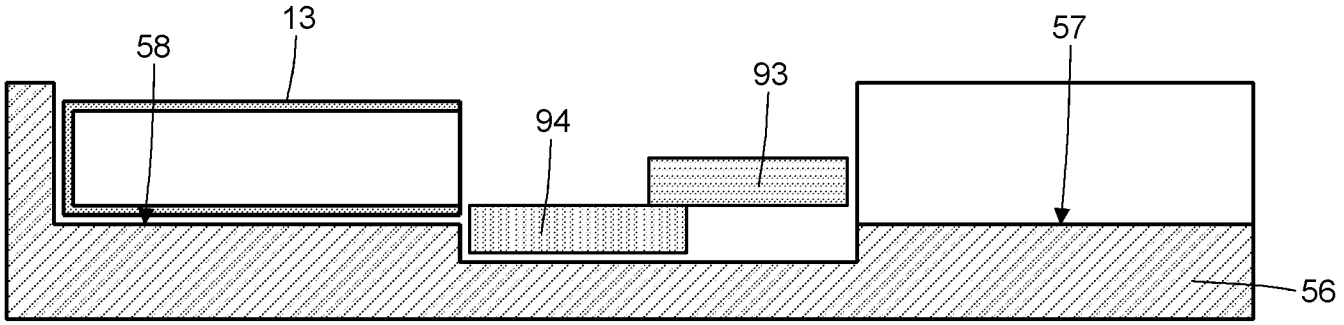
Figure 26:
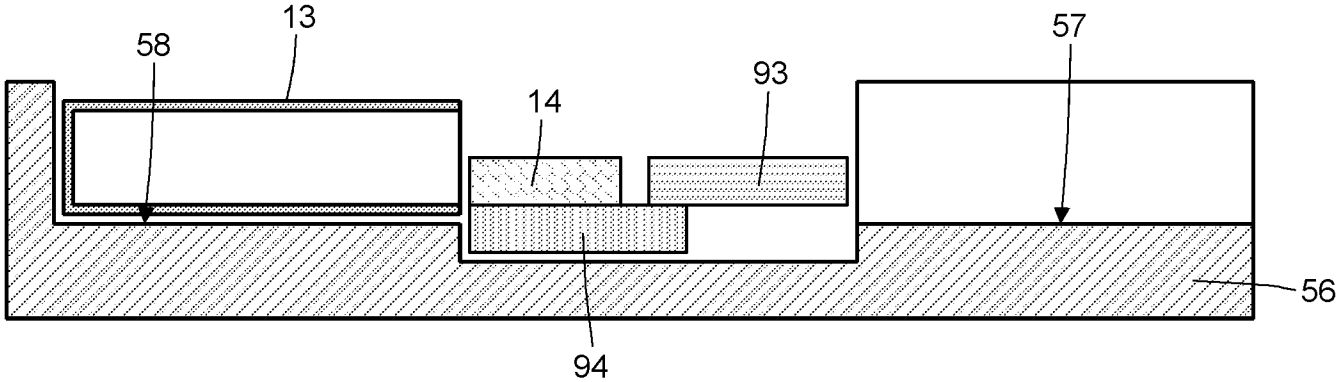
Figure 27:
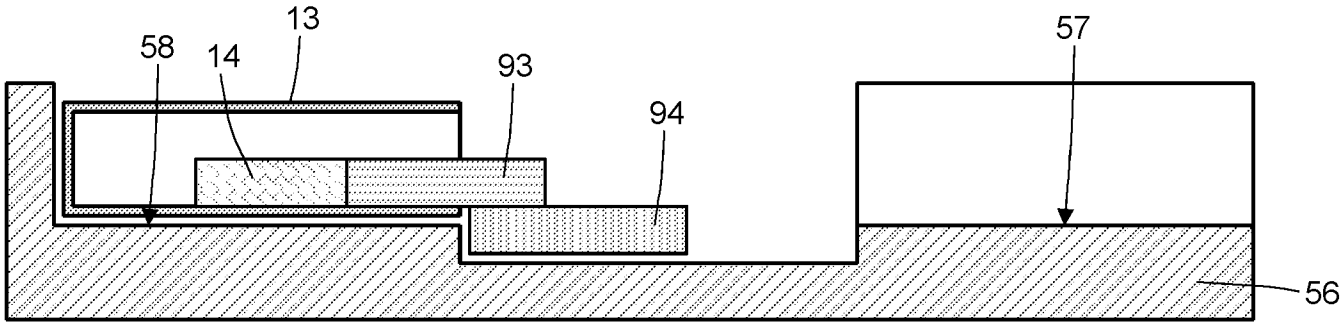
Figure 28:
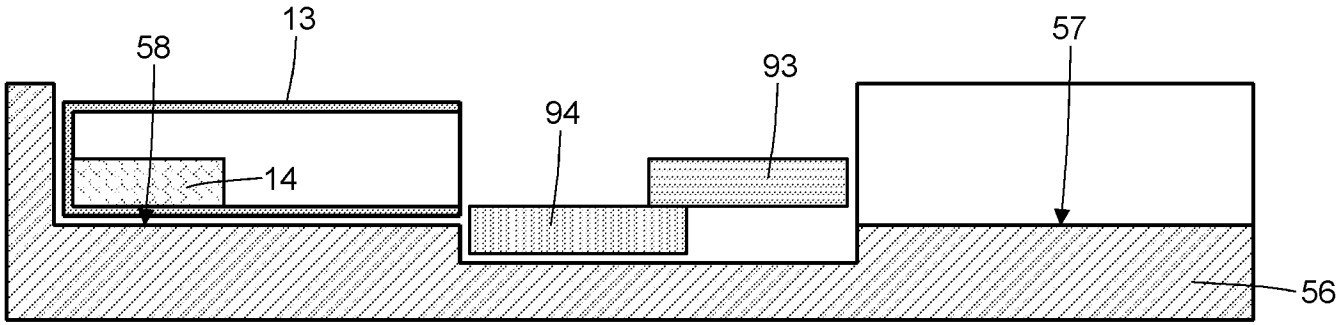
Figure 29:
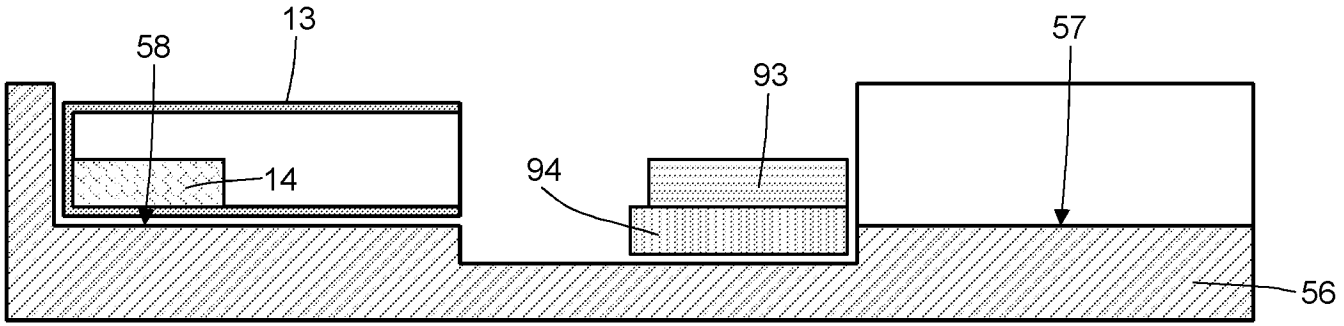
Figure 30:
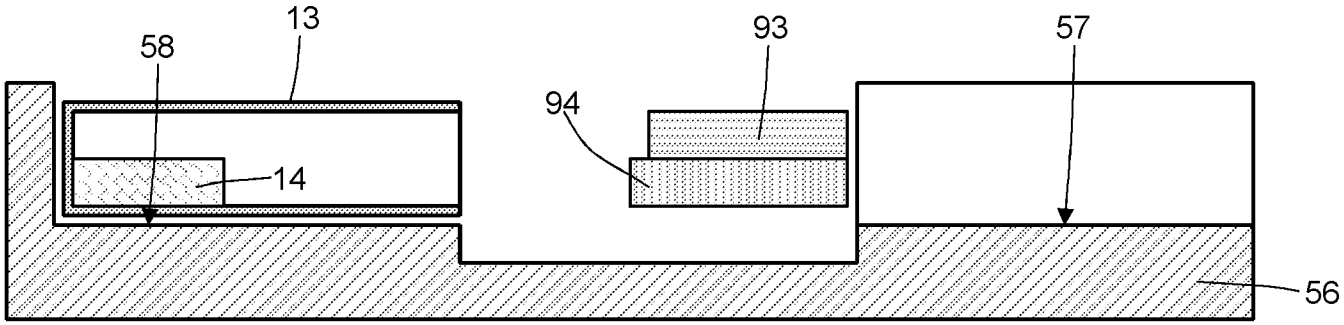
Figure 31:
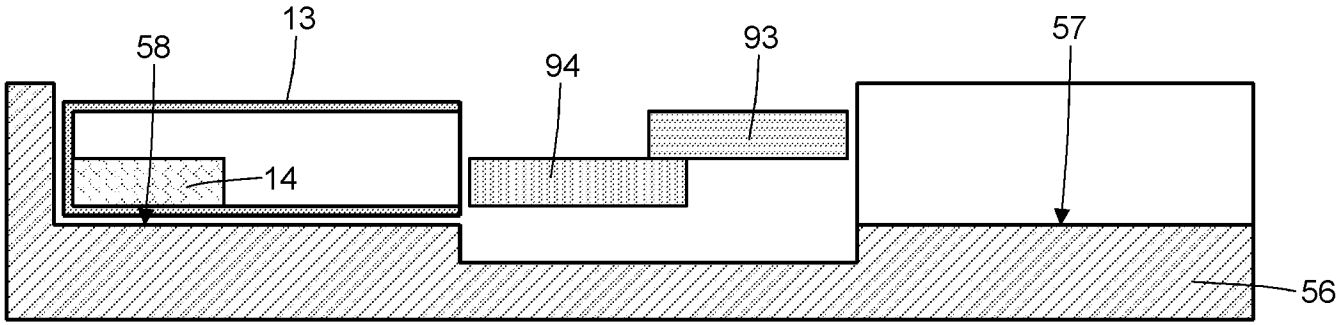
Figure 32:
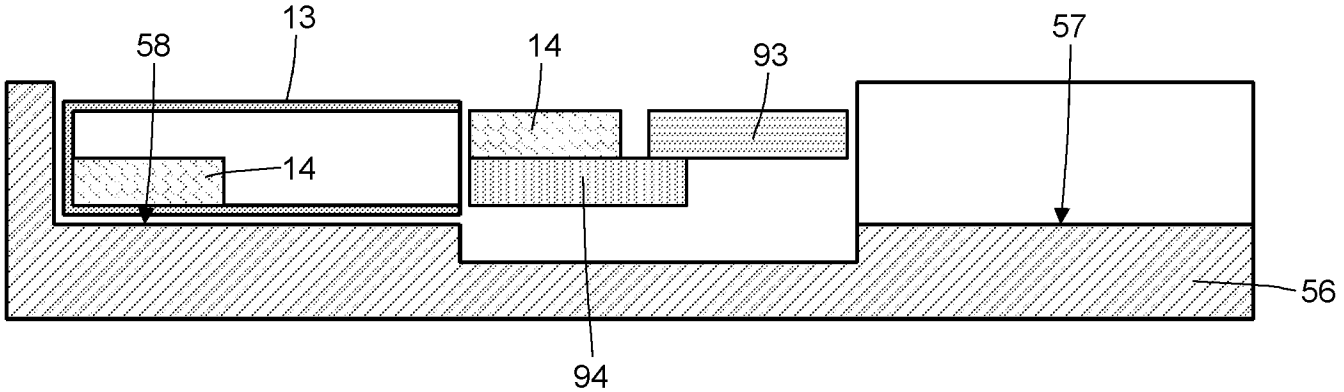
Figure 33:
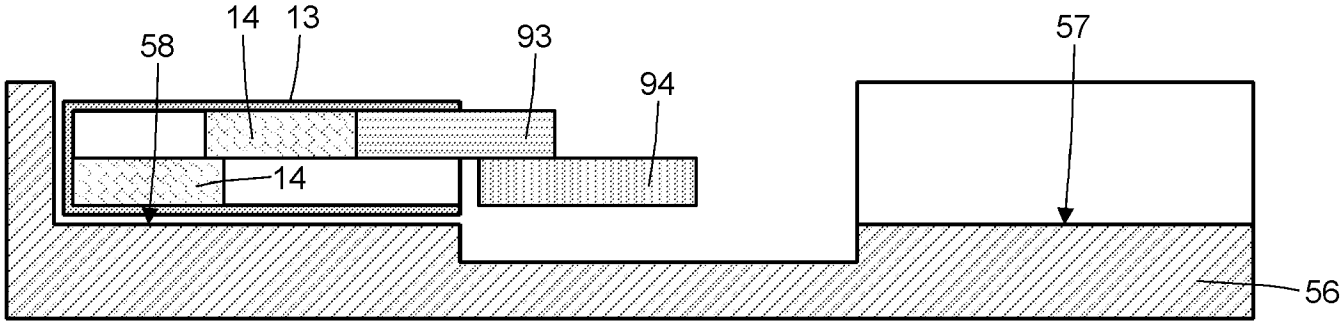
Figure 34:
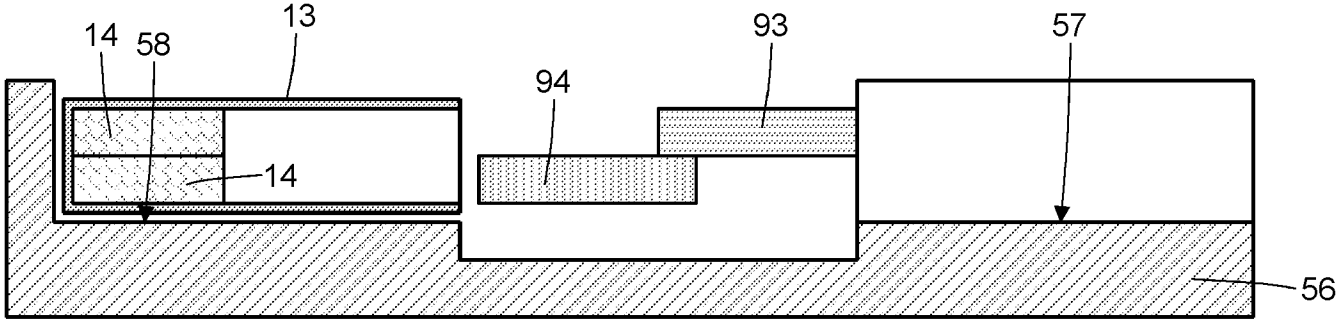
Figure 35:
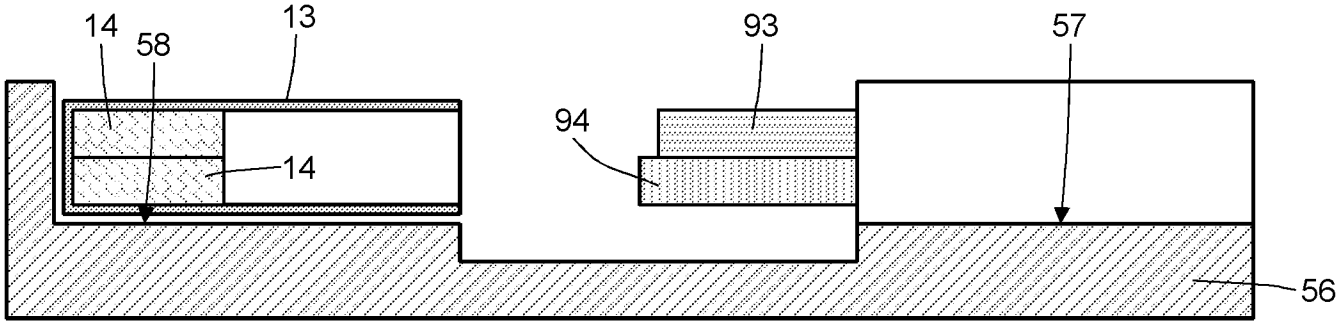

Initially and as illustrated in FIG. 24, when four movable plates 56 are standing still in the coupling station S20, the pusher 93 and the support plane 94 are arranged one above the other in front of each mouthpiece 13 housed in a seat 58 of one of the four movable plates 56 standing still. Subsequently and as illustrated in FIG. 25, the support plane 94 moves (translates) relative to the pusher 93 to exit from below the pusher 93. At this point and as illustrated in FIG. 26, the (twelve) gripping heads 91 rest twelve absorbent pads 14 above the support plane 94. Subsequently and as illustrated in FIG. 27, the pusher 93 moves (translates) relative to the support plane 94 to push the twelve absorbent pads 14 into as many mouthpieces 13 carried by the seats 58 of the four movable plates 56 standing still in the coupling station S20. At the end of the insertion of the twelve absorbent pads 14 inside as many mouthpieces 13 and as shown in FIGS. 28 and 29, the pusher 93 and the support plane 94 are returned to the initial position. Once the initial position is reached and as illustrated in FIG. 30, the pusher 93 and the support plane 94 (one above the other) are raised vertically to reach a higher level which is (immediately) above the level of the absorbent pads 14 already inserted into the mouthpieces 13 carried by the seats 58 of the four movable plates 56 standing still in the coupling station S20. Subsequently and as illustrated in FIG. 31, the support plane 94 moves (translates) relative to the pusher 93 to exit from below the pusher 93. At this point and as illustrated in FIG. 32, the (twelve) gripping heads 91 rest twelve absorbent pads 14 above the support plane 94. Subsequently and as illustrated in FIG. 33, the pusher 93 moves (translates) relative to the support plane 94 so as to push the twelve absorbent pads 14 into as many mouthpieces 13 carried by the seats 58 of the four movable plates 56 standing still in the coupling station S20 and above the twelve absorbent pads 14 previously inserted into the mouthpieces 13. At the end of the insertion of the twelve absorbent pads 14 into the same mouthpieces 13 and as illustrated in FIGS. 34 and 35, the pusher 93 and the support plane 94 are brought back to their initial position, thus ending the insertion of a pair of absorbent pads 14 into each mouthpiece 13 of the twelve seats 58 of the four movable plates 56 standing still in the coupling station S20; at this point the four movable plates 56 standing still in the coupling station S20 start moving along the assembling path and four new movable plates 56 arrive to the coupling station S20 where they are standing still.

Figure 20:
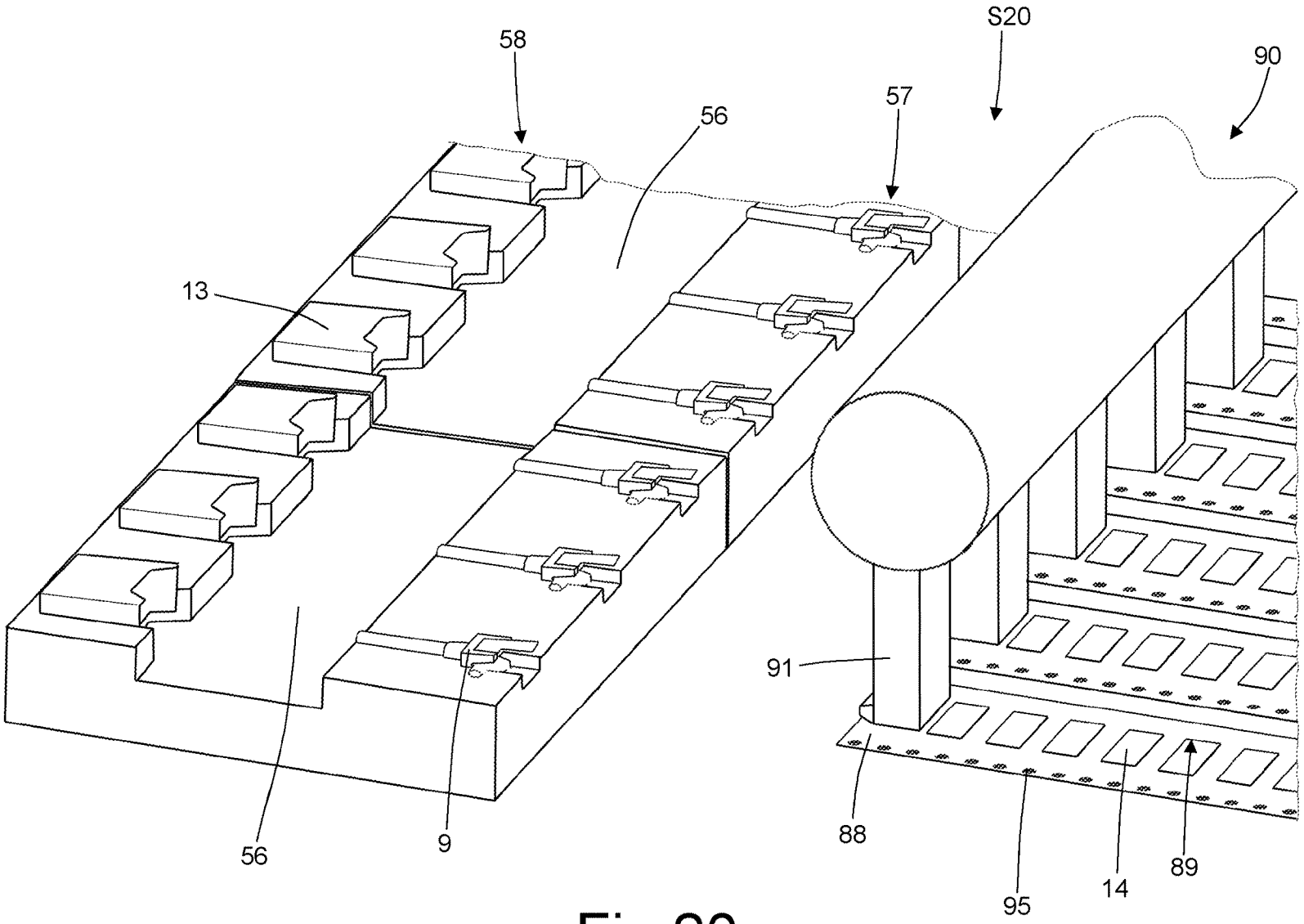
FIGS. 20 and 21 are two different perspective and schematic views of part of the feeding station of FIG. 19.
Figure 21:
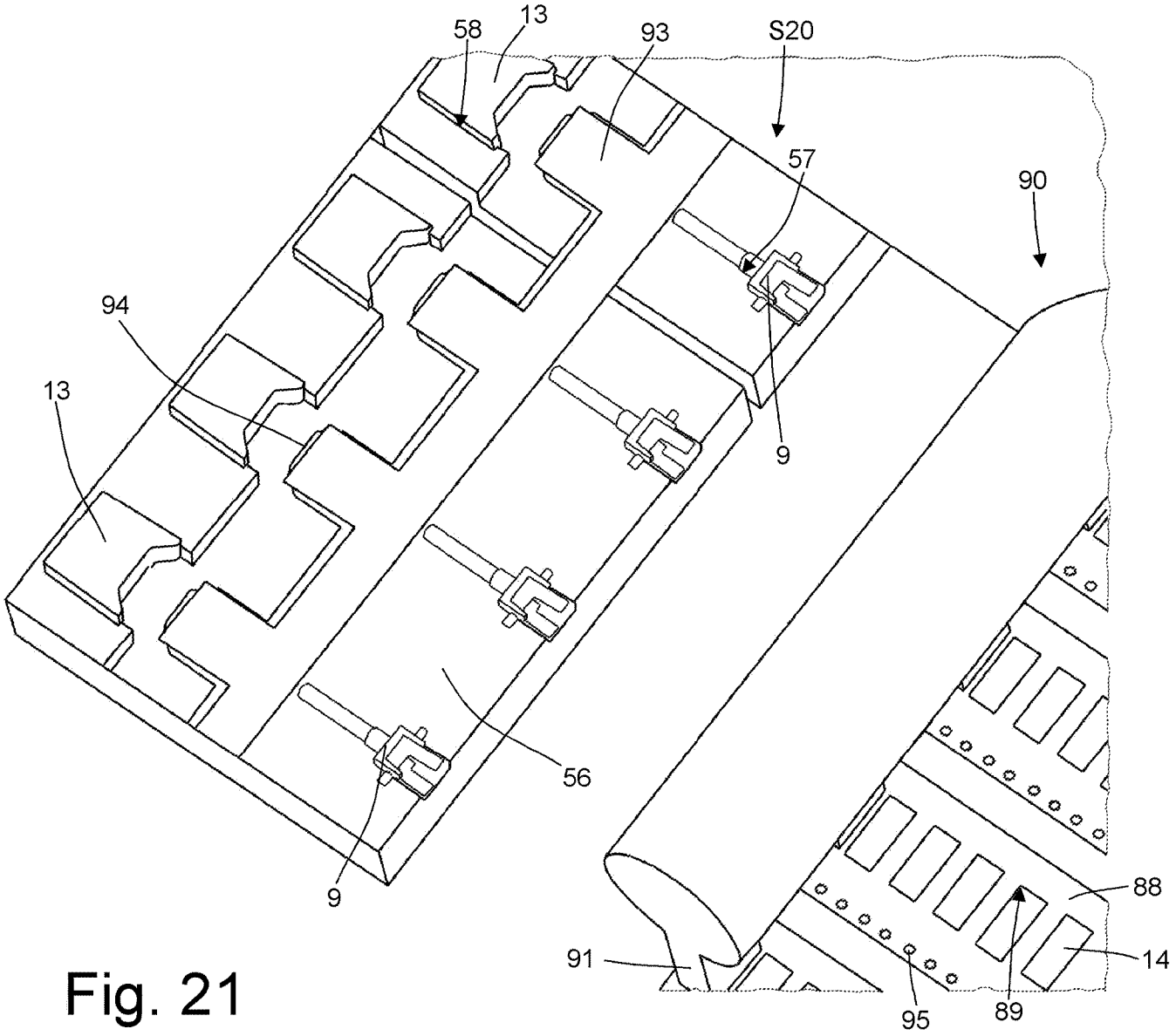
Figure 22:
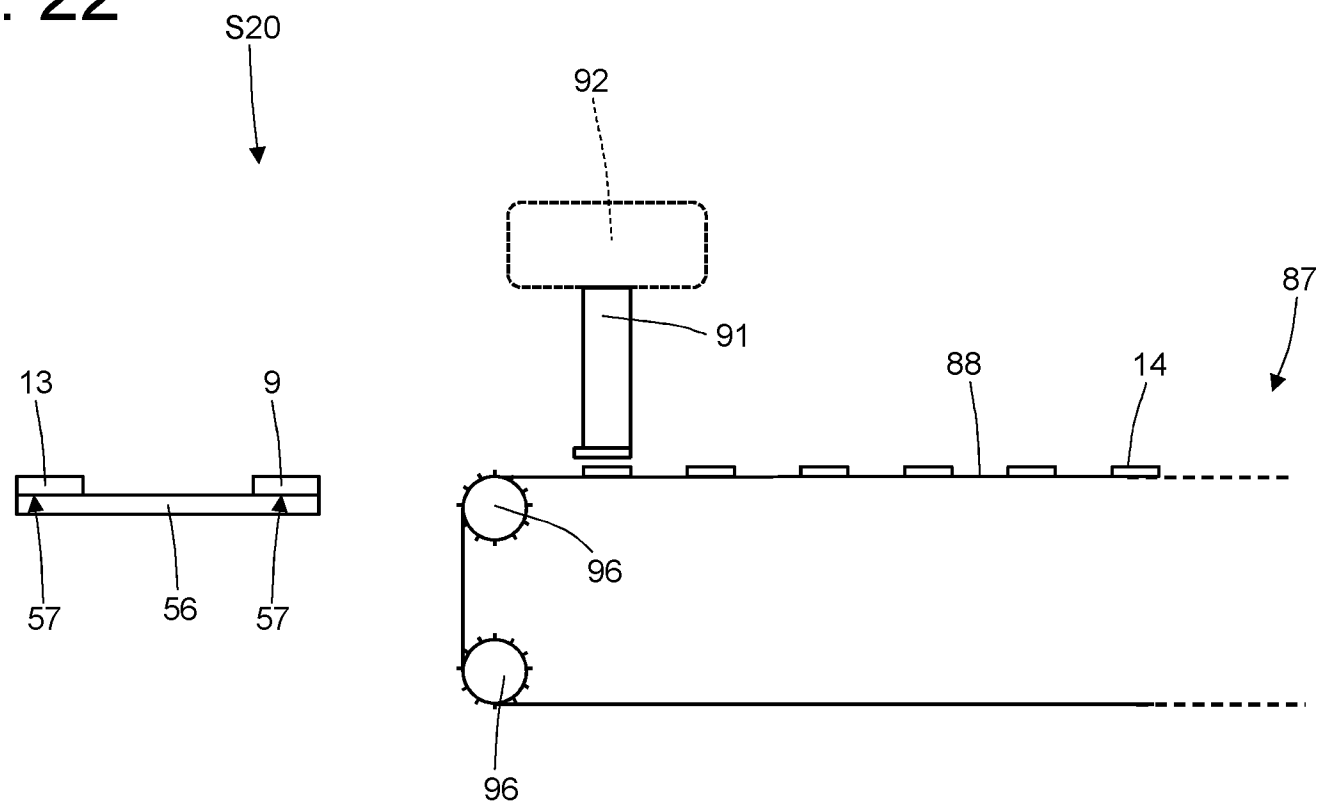
FIGS. 22 and 23 are two lateral and schematic views of the feeding station of FIG. 19 in two different operating moments.
Figure 23:
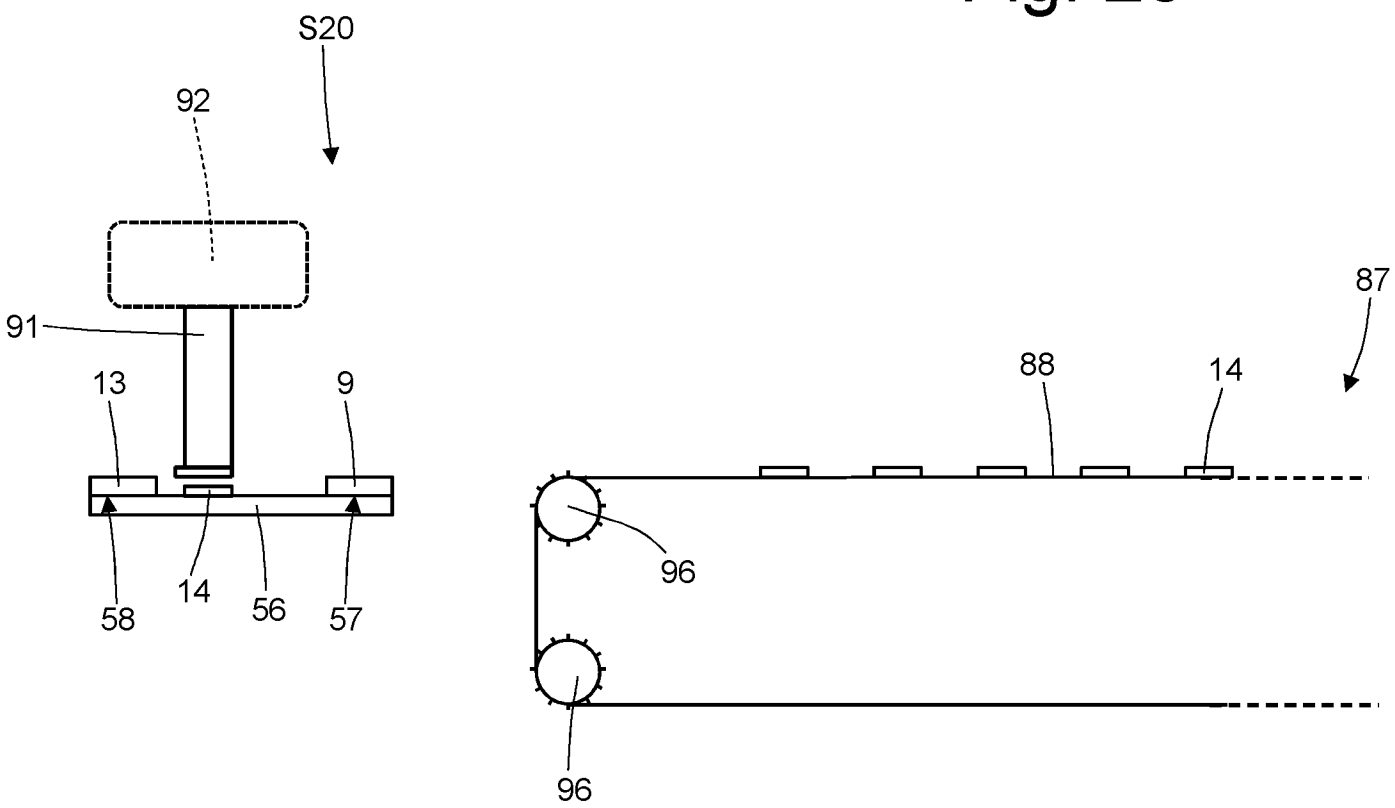

As illustrated in FIGS. 20 and 21, each band 88 has a succession of through guide holes 95 which are used to move the band 88; for this purpose and according to what is illustrated in FIGS. 22 and 23, each moving device 87 has a plurality of toothed guide drums 96 having a plurality of teeth each designed to engage a corresponding guide hole 95 of the band 88.

Figure 36:
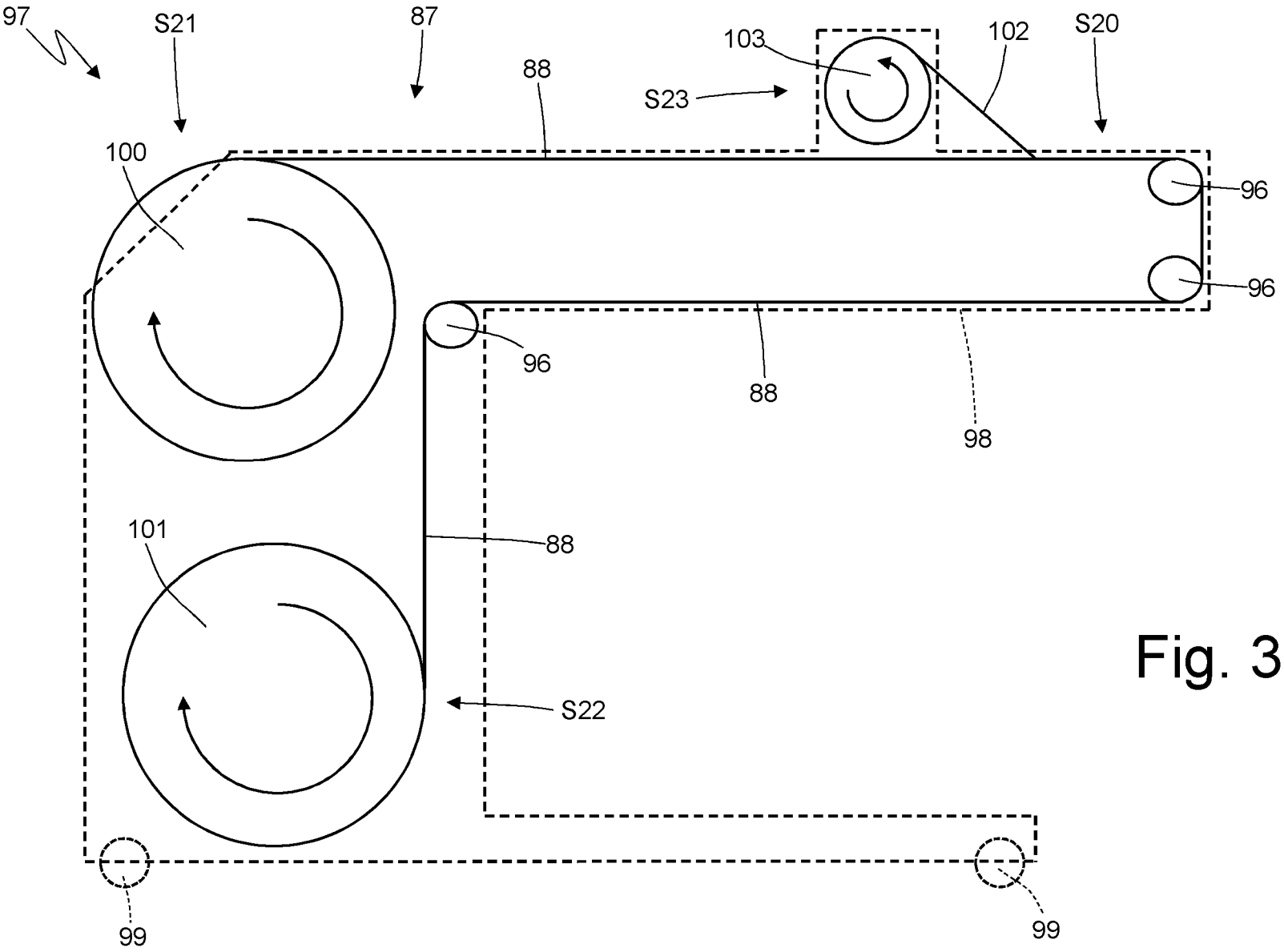
FIG. 36 a side and schematic view of a feeding trolley of the feeding station of FIG. 19.

As illustrated in FIG. 36, each moving device 87 is housed in a feeding trolley 97 which is completely similar to the feeding trolleys 76 of the two feeding stations S15 and is independent from the rest of the assembling section 16 of the manufacturing machine 15, i.e. it is designed to be separable (even in use) from the rest of the assembling section 16 of the manufacturing machine 15; in other words, each feeding trolley 97 is designed to be quickly inserted or uninserted from the rest of the assembling section 16 of the manufacturing machine 15. For this purpose, each feeding trolley 97 comprises its own frame 98 which is "C"-shaped and is provided at the bottom with wheels 99 for sliding without friction on the floor on which the support body 18 of the assembling section 16 of the manufacturing machine 15 rests. The frame 98 of each feeding trolley 97 supports an unwinding station S21 which houses a plurality of reels 100 (in particular twelve reels 100) beside one another and parallel to one another inside of which a new band 88 is wound (i.e. the pockets 89 of which contain respective absorbent pads 14); furthermore, the frame 98 of each feeding trolley 97 supports a winding station S22 which houses a plurality of reels 101 (in particular twelve reels 101) beside one another and parallel to one another inside of which a used band 88 is wound (i.e. the pockets 89 of which are empty and therefore no longer contain respective absorbent pads 14). In use, each of the twelve bands 88 is unwound from a reel 100 in the unwinding station S21, is passed through the coupling station S20 in which the absorbent pads 14 are picked up from the corresponding pockets 89, and finally is wound around the reel 101 in the winding station S22.

According to a preferred embodiment, each band 88 is provided with a protective film 102 (typically a transparent plastic material) which closes the pockets 89 at the top and is separated from the band 88 (to reveal the pockets 89) immediately upstream of the coupling station S20; in particular, each protective film 102, after being separated from the band 88, is wound in a reel 103 arranged in a winding station S23 (arranged above the band 88).

When the two coupling stations S20 are used alternatively, in the coupling station S20 at that moment the unused feeding trolley 97 can be decoupled from the assembling section 16 to remove the exhausted reel 100 and the full reels 100 and 101 and insert a new full reel 100 and new empty reels 100 and 101, i.e. to perform the renewal of the assembly materials.

In the embodiment illustrated in the attached figures, the two feeding trolleys 97 enter the assembling section 16 from the rear (i.e. from the opposite side of the front of the machine); according to an alternative embodiment, the two feeding trolleys 97 enter the assembling section 16 from the front (i.e. from the front of the machine).

In the transfer station S14 arranged at end of the assembling path, a support 9 (provided with a wick 7 and with a tube 12) and a mouthpiece 13 (provided with a pair of absorbent pads 14) are picked up simultaneously from a seat 57 and from a seat 58 of a movable plate 56 standing still in the transfer station S14.

Figure 37:
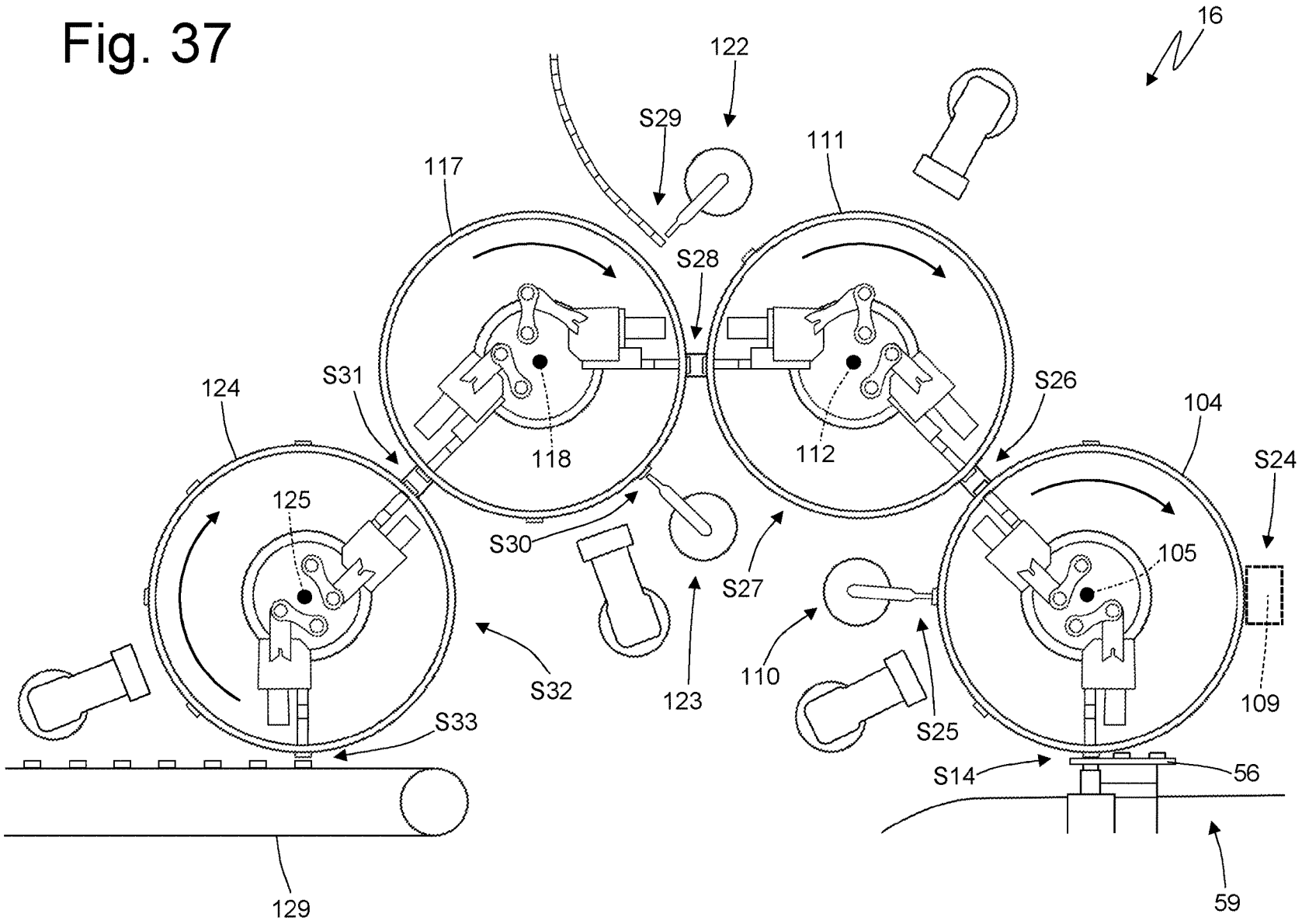
FIG. 37 is a front and schematic view of a final part of the manufacturing machine of FIG. 4.
Figure 38:
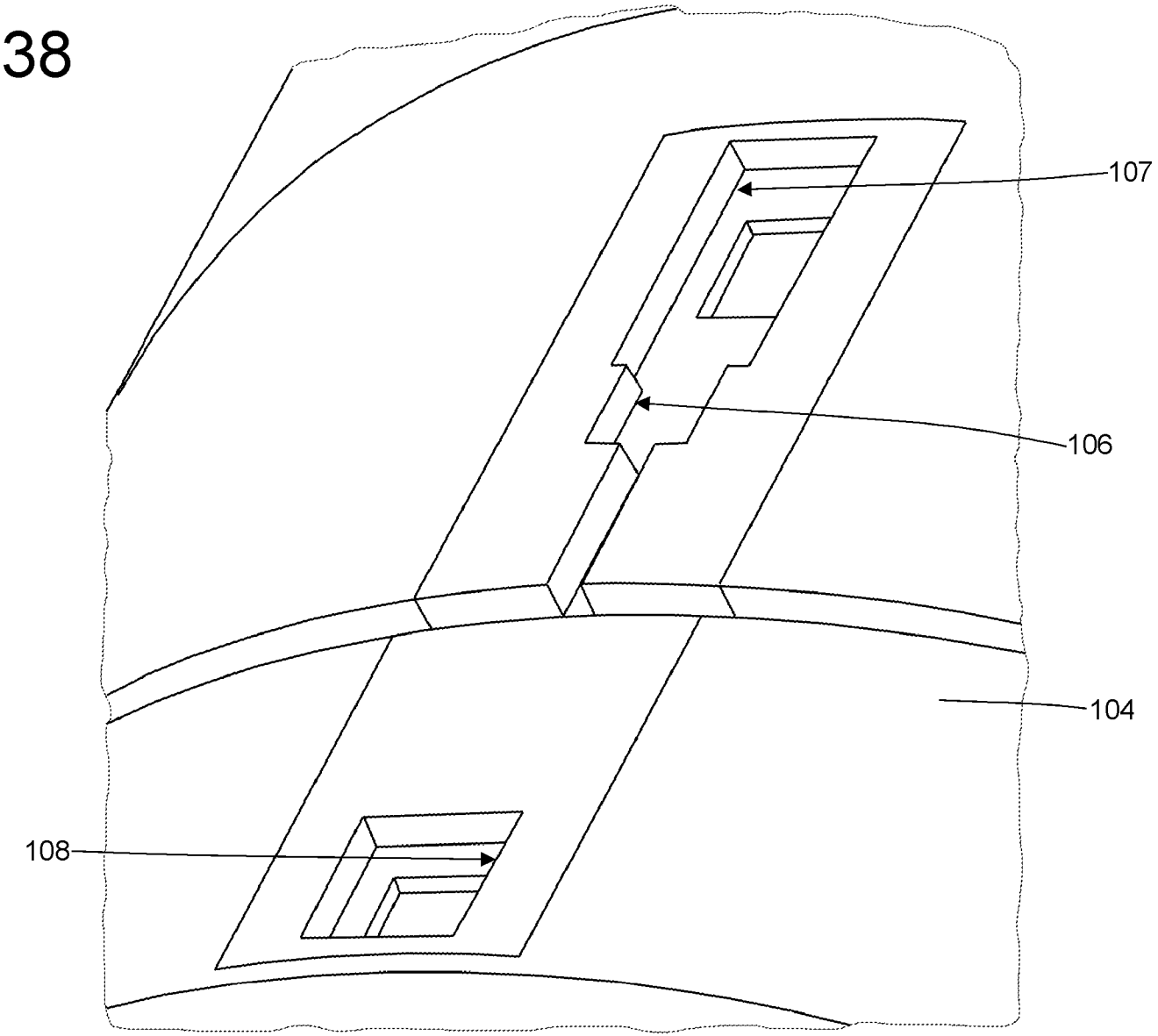
FIG. 38 is a perspective view of two seats of a first assembling drum of the final part of FIG. 37.

As illustrated in FIG. 37, the final part C of the manufacturing machine 15 comprises a vertically arranged assembling drum 104 which is mounted rotatable around a horizontal rotation axis 105 so as to rotate with intermittent motion (i.e. in a stepwise manner by cyclically alternating motion steps and still steps) around the rotation axis 105. As illustrated in FIG. 38, the assembling drum 104 has a plurality of suction seats 106 each designed to house a support 9 of a heating device 6 (coupled to a wick 7 provided with an electrical coil 8 and a tube 12), a plurality of suction seats 107, each of which is axially aligned with a corresponding seat 106 and is designed to house a tank 5, and a plurality of suction seats 108, each of which is axially aligned with a corresponding seat 106 and with a corresponding seat 107 and is designed to house a mouthpiece 13.

As illustrated in FIG. 37, a feeding station S24 is provided, where a feeding device 109 is provided which feeds a tank 5 in a seat 107 standing still. The feeding device 109 comprises a feeding conveyor provided with a vertical channel along which the tanks 5 drop by gravity (pneumatic feeding could possibly also be provided); at the end of the channel a pusher is arranged, which by means of a horizontal movement, pushes a tank 5 from the channel to a seat 107 standing still in the feeding station S24.

As illustrated in FIG. 37, the transfer station S14 is arranged downstream of the feeding station S24 relative to the rotation direction of the assembling drum 104; in the transfer station S14 a support 9 of a heating device 6 is transferred vertically (with a movement from the bottom upwards) from a seat 57 of a movable plate 56 standing still, to a seat 106 of the assembling drum 104 and, simultaneously, a mouthpiece 13 is transferred vertically (with a movement from the bottom upwards) from the seat 58 of the movable plate 56 standing still, to a seat 108 of the assembling drum 104.

Figure 39:
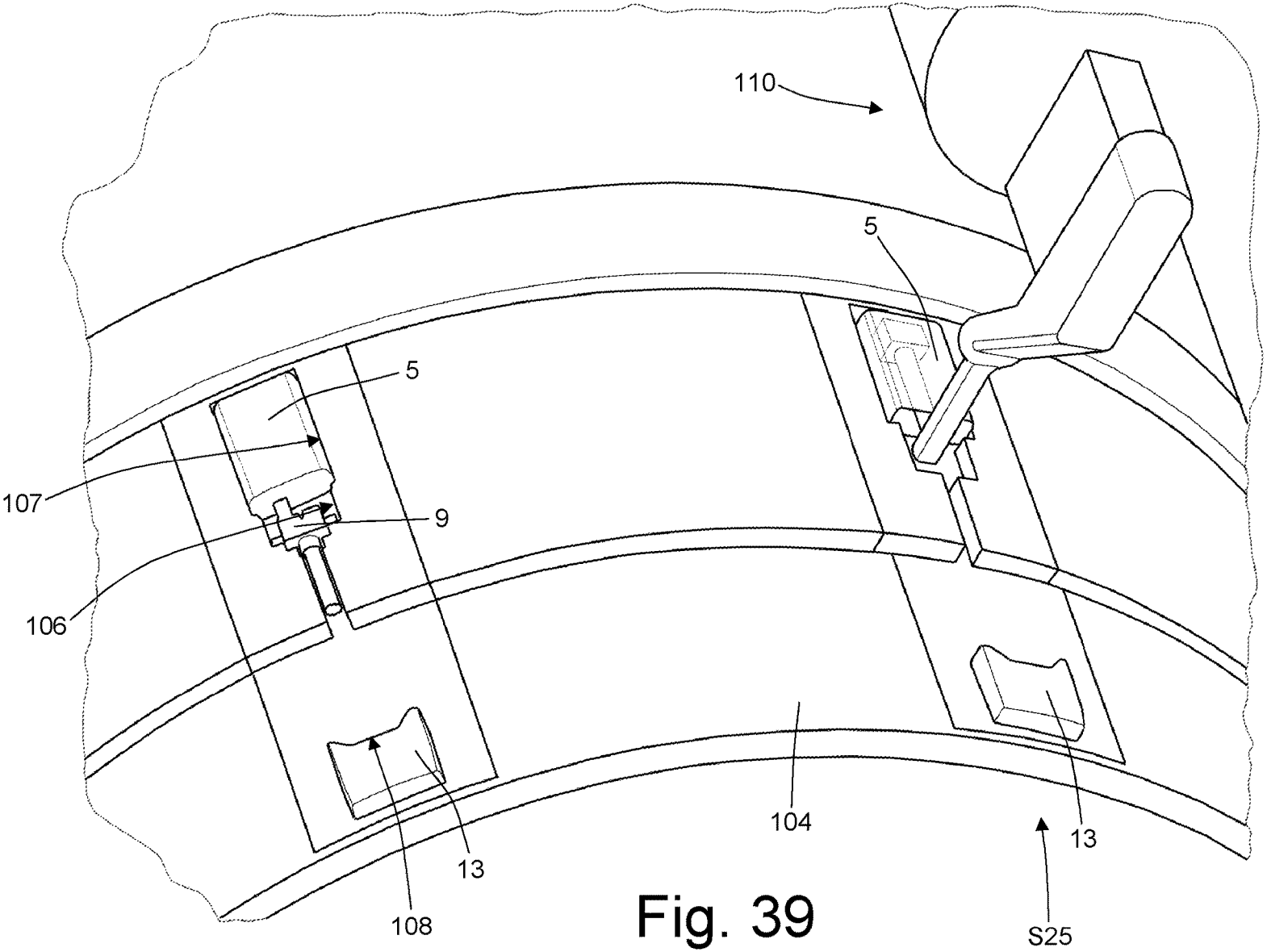
FIG. 39 is a perspective view of an insertion station of the first assembling drum of FIG. 38.

As illustrated in FIG. 39, an insertion station S25 is provided which is arranged downstream of the transfer station S14 (therefore also downstream of the feeding station S24) relative to the rotation direction of the assembling drum 104 and is provided with a pushing device 110; in use, when the assembling drum 104 is standing still, the pushing device 110 axially moves the support 9 of a heating device 6 from a seat 106 to a seat 107 so as to insert the support 9 into a tank 5 carried by the seat 107.

Figure 40:
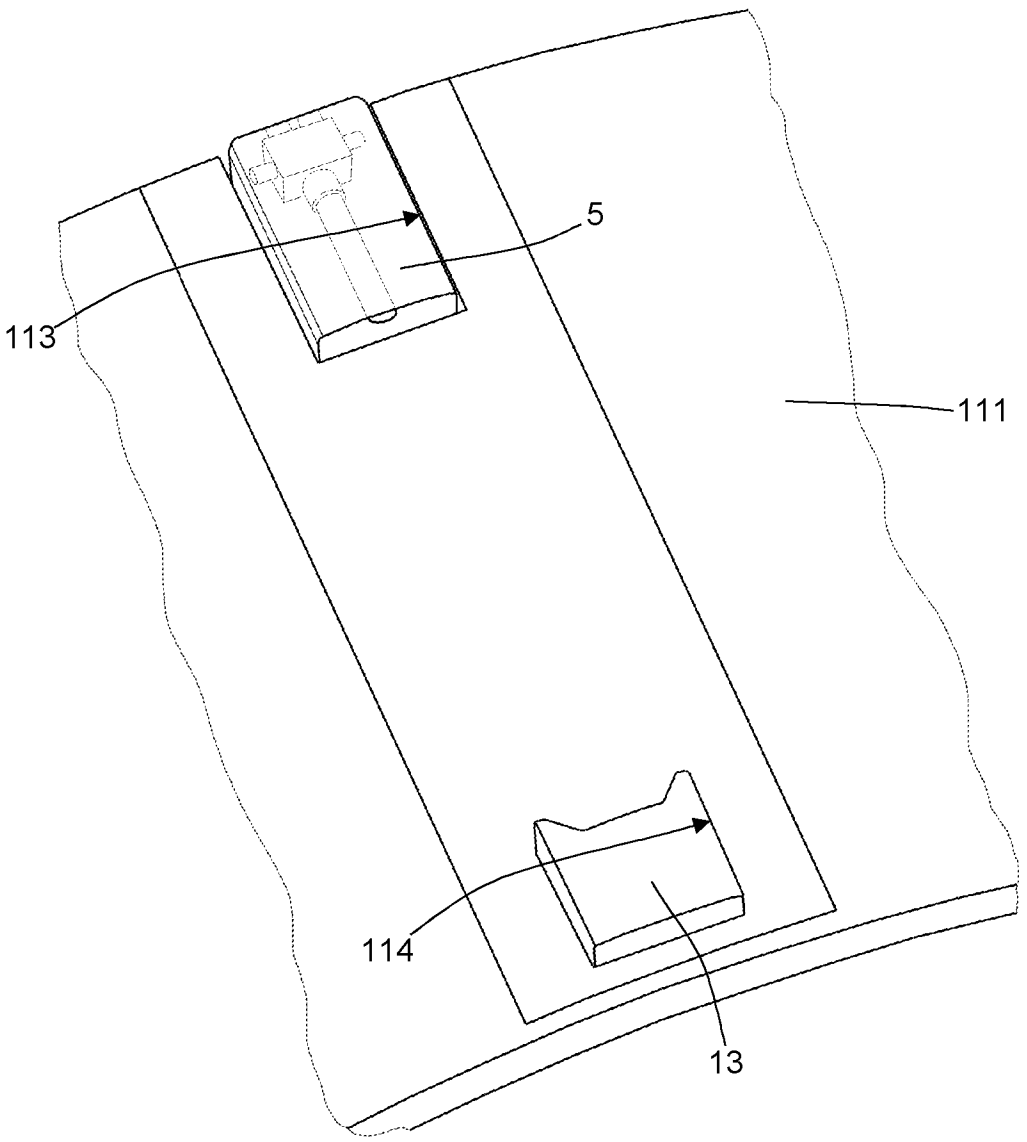
FIG. 40 is a perspective view of two seats of a second assembling drum of the final part of FIG. 37.
Figure 41:
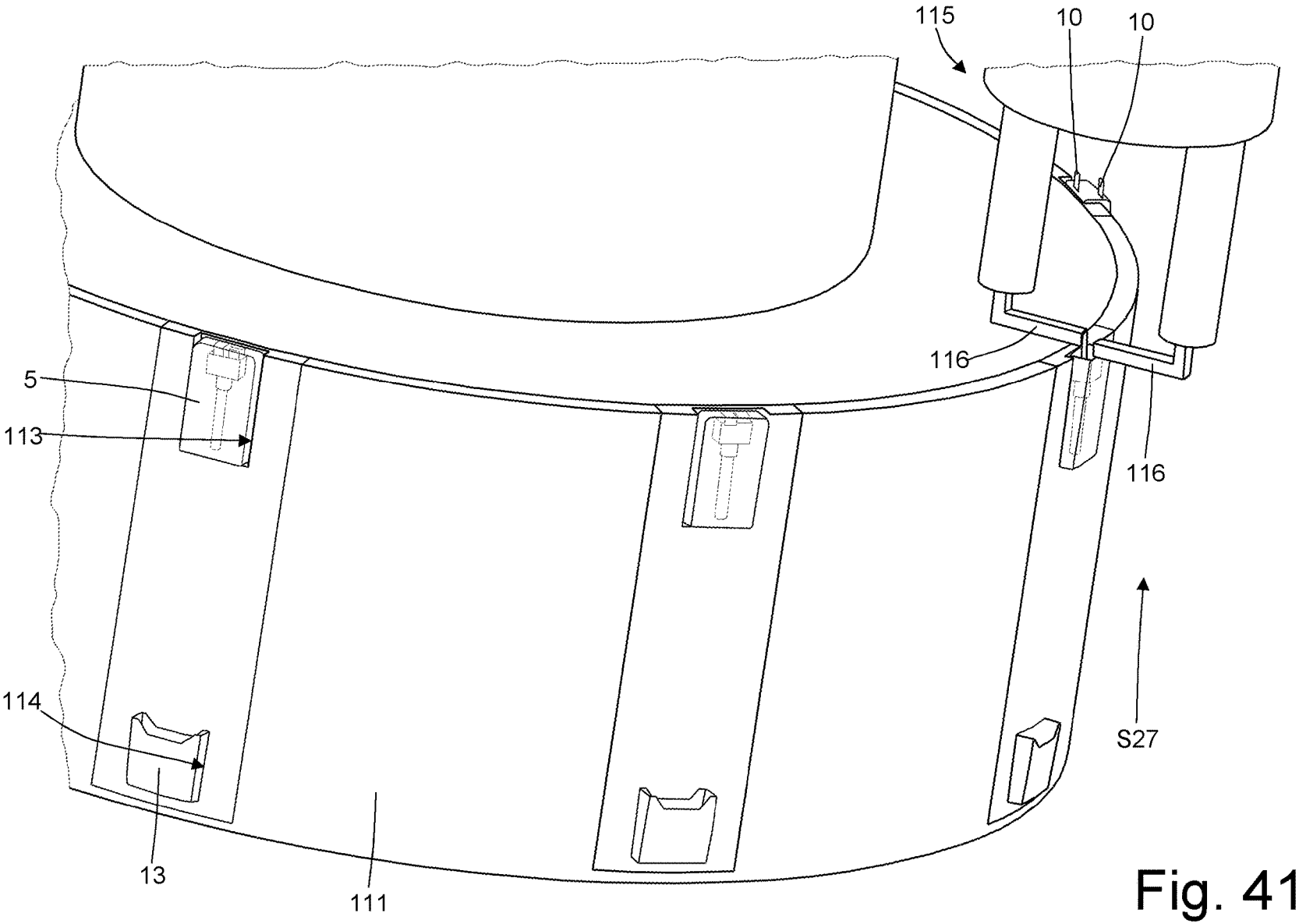
FIG. 41 is a perspective view of a bending station of the second assembling drum of FIG. 40.

As illustrated in FIG. 37, the final part C comprises an assembling drum 111 which is mounted rotatable around a rotation axis 112 parallel to the rotation axis 105 so as to rotate with intermittent motion (i.e. in a stepwise manner by cyclically alternating motion steps and still steps) around the rotation axis 112. As illustrated in FIG. 40, the assembling drum 111 has a plurality of suction seats 113 each designed to house a tank 5 (internally provided with support 9 for a heating device 6) and a plurality of suction seats 114, each of which is axially aligned with a corresponding seat 113 and is designed to house a mouthpiece 13. As illustrated in FIG. 37, the assembling drum 111 is tangent to the assembling drum 104 in a transfer station S26 in which, when both assembly drums 104 and 111 are standing still, a tank 5 is transferred from a seat 106 of the assembling drum 104 to a seat 113 of the assembling drum 111 and, simultaneously, a mouthpiece 13 is transferred from a seat 108 of the assembling drum 104 to a seat 114 of the assembling drum 111. As illustrated in FIG. 41, a bending station S27 is provided, which is arranged downstream of the transfer station S26 relative to the rotation direction of the assembling drum 111 and where a bending device 115, which bends the two conductor elements 10, integral to a support 9 of a heating device 6 inserted into a tank 5 carried by a seat 113 standing still in the bending station S27. The bending device 115 comprises two bending devices 116, which with a radial movement (i.e. perpendicular to the rotation axis 112) bends the two conductor elements 10 by 90°.

Figure 42:
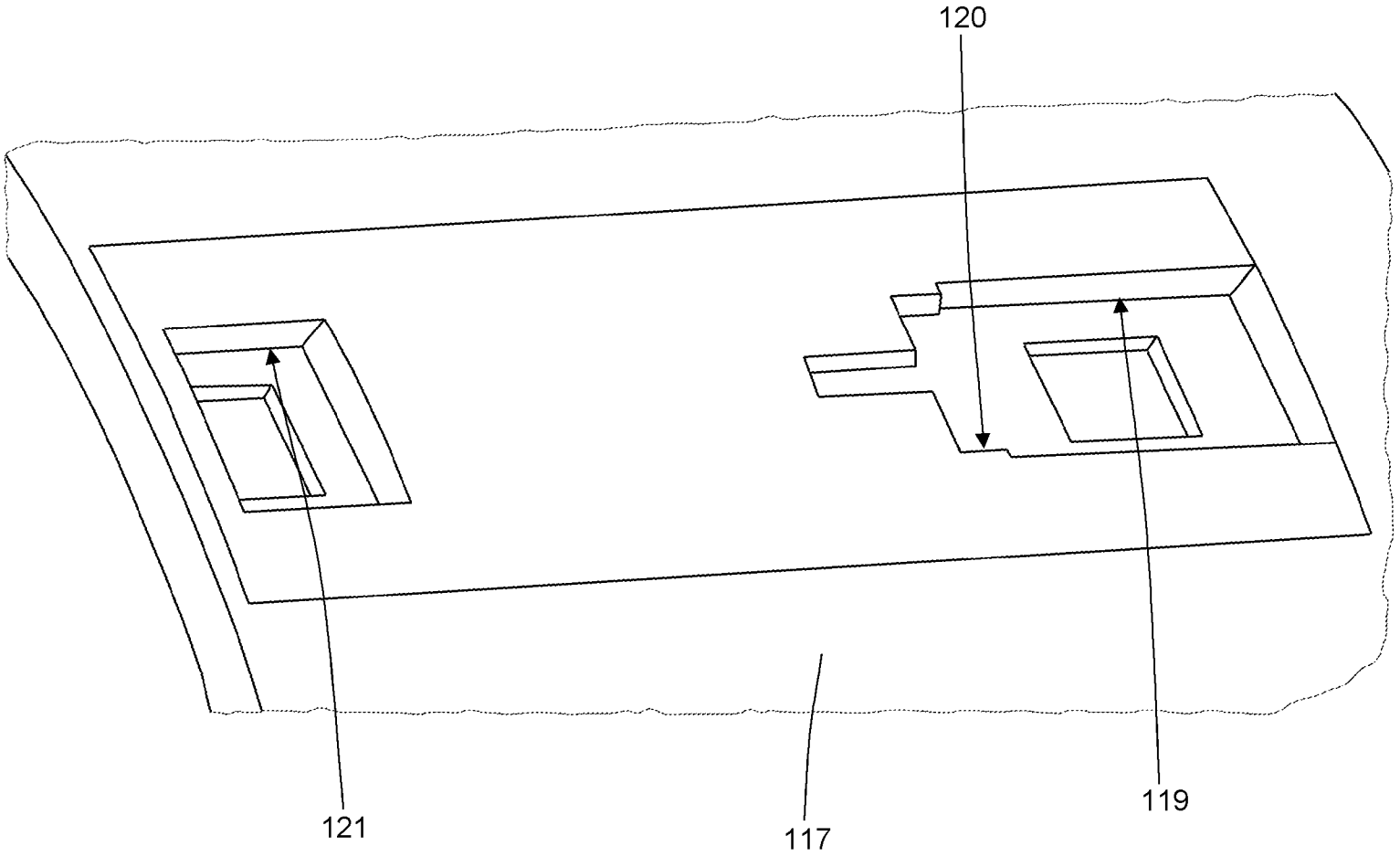
FIG. 42 is a perspective view of two seats of a third assembling drum of the final part of FIG. 37.

As illustrated in FIG. 37, the final part C comprises an assembling drum 117, which is mounted rotatable around a rotation axis 118 parallel to the rotation axis 112 so as to rotate with intermittent motion (i.e. in a stepwise manner by cyclically alternating motion steps and still steps) around the rotation axis 118. As illustrated in FIG. 42, the assembling drum 117 has a plurality of suction seats 119 each designed to house a tank 5 (internally provided with support 9 for a heating device 6), a plurality of seats 120, each of which is axially aligned with a corresponding seat 119 and is designed to house a plug 11, and a plurality of suction seats 120, each of which is axially aligned with a corresponding seat 119 and with a corresponding seat 120 and is designed to house a mouthpiece 13. As illustrated in FIG. 37, the assembling drum 117 is tangent to the assembling drum 111 in a transfer station S28 where, when both assembling drums 111 and 117 are standing still, a tank 5 is transferred from a seat 113 of the assembling drum 111 to a seat 119 of the assembling drum 117 and, simultaneously, a mouthpiece 13 is transferred from a seat 108 of the assembling drum 111 to a seat 121 of the assembling drum 117.

As illustrated in FIG. 37, a feeding station S29 is provided, which is arranged upstream of the transfer station S28 relative to the rotation direction of the assembling drum 117 and where a feeding device 122 is provided, which feeds a plug 11 in a seat 120 standing still. The feeding device 122 comprises a feeding conveyor provided with a substantially vertical channel along which the plugs 11 fall by gravity (pneumatic feeding could possibly also be provided); at the end of the channel a pusher is provided, which, by means of a movement tilted by 45° relative to the horizontal, pushes a plug 11 from the channel to a seat 120 which is standing still in the feeding station S29.

Figure 43:
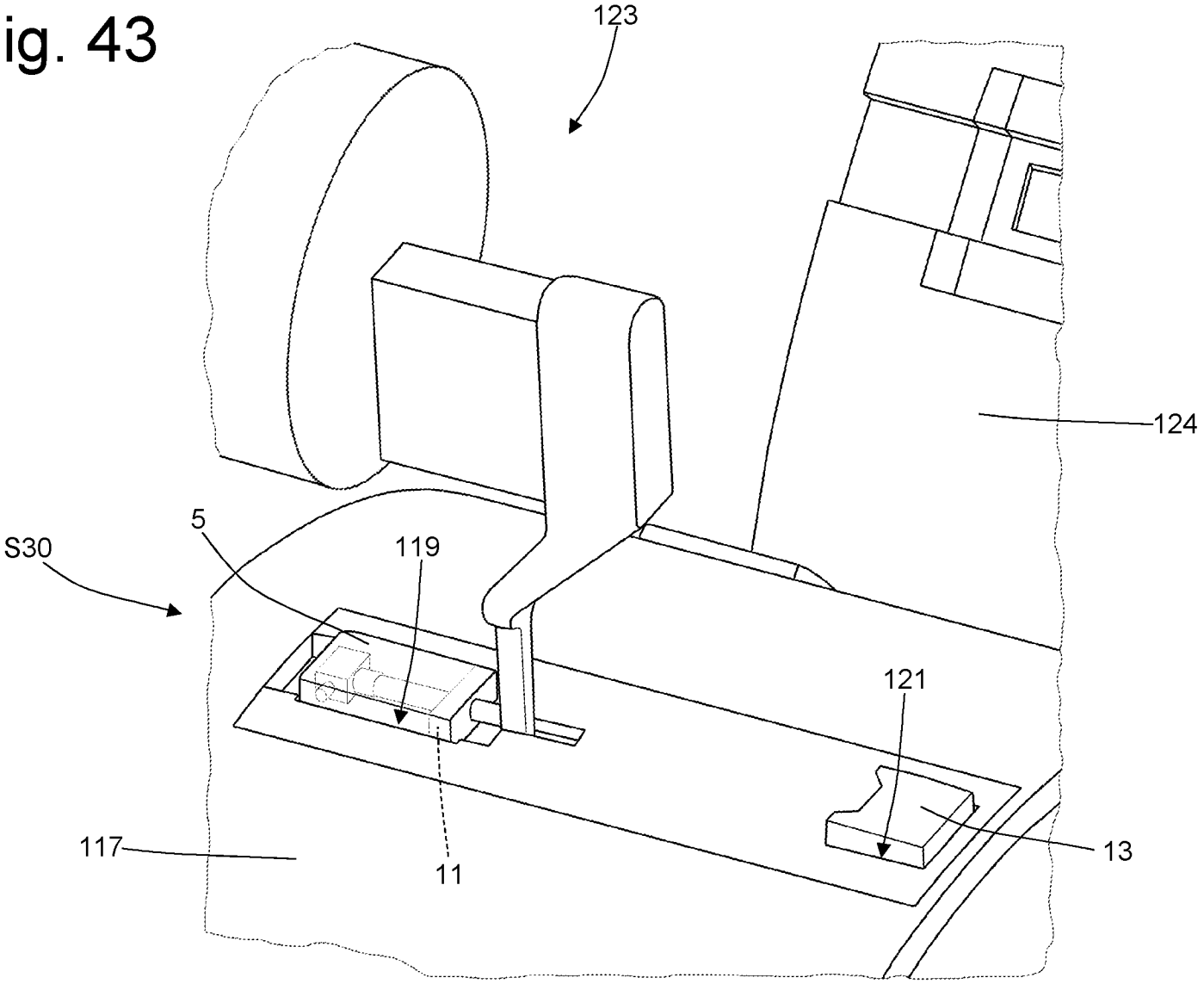
FIG. 43 is a perspective view of an insertion station of the third assembling drum of FIG. 42.

As illustrated in FIG. 43, an insertion station S30 is provided, which is arranged downstream of the transfer station S28 (therefore also downstream of the feeding station S29) relative to the rotation direction of the assembling drum 117 and is provided with a pushing device 123; in use, when the assembling drum 117 is standing still, the pushing device 123 axially moves a plug 11 from a seat 120 to a seat 119 so as to insert the plug 11 into a tank 5 carried by the seat 119.

Figure 44:
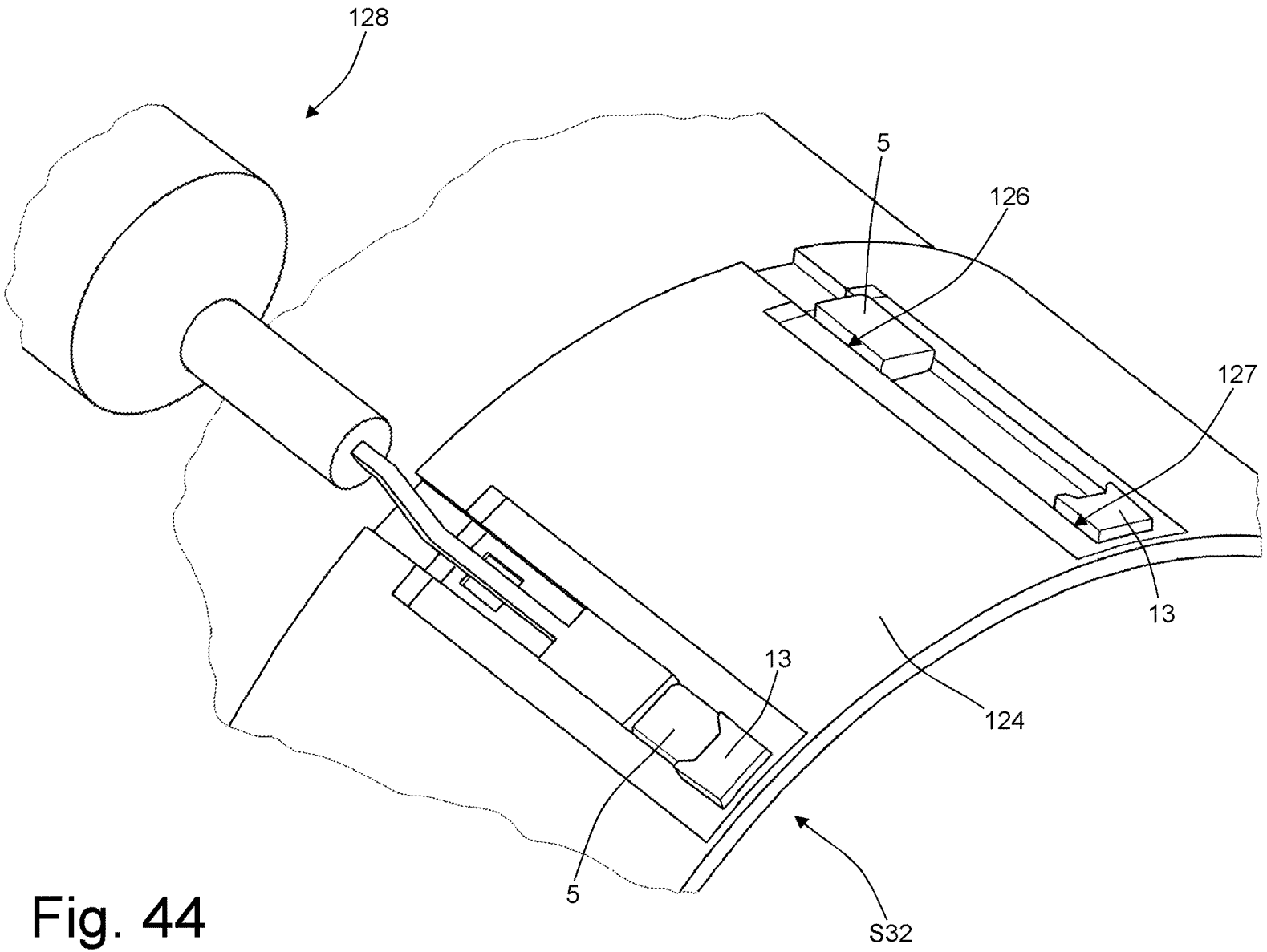
FIG. 44 is a perspective view of an insertion station of a fourth assembling drum of the final part of FIG. 37.

As illustrated in FIG. 37, the final part C comprises an assembling drum 124 which is mounted rotatable around a rotation axis 125 parallel to the rotation axis 118 so as to rotate with intermittent motion (i.e. in a stepwise manner by cyclically alternating motion steps and still steps) around the rotation axis 125. As illustrated in FIG. 44, the assembling drum 124 has a plurality of suction seats 126 each designed to house a tank 5 (internally provided with support 9 for a heating device 6), and a plurality of suction seats 127, each of which is axially aligned with a corresponding seat 126 and is designed to house a mouthpiece 13. As illustrated in FIG. 37, the assembling drum 124 is tangent to the assembling drum 117 in a transfer station S31 where, when both assembling drums 117 and 124 are standing still, a tank 5 is transferred from a seat 119 of the assembling drum 117 to a seat 126 of the assembling drum 124 and, simultaneously, a mouthpiece 13 is transferred from a seat 121 of the assembling drum 117 to a seat 127 of the assembling drum 124.

As illustrated in FIG. 44, an insertion station S32 is provided, which is arranged downstream of the transfer station S31 relative to the rotation direction of the assembling drum 124 and is provided with a pushing device 128; in use, when the assembling drum 124 is standing still, the pushing device 128 axially moves a tank 5 from a seat 126 to a seat 127 so as to insert the tank 5 into a mouthpiece 13 carried by the seat 127.

As illustrated in FIG. 37, the final part C comprises an outlet belt conveyor 129 which is arranged horizontally below the assembling drum 124 and receives the nearly complete cartridges 1 (only the caps 4 are missing) from the assembling drum 124. In particular, the assembling drum 124 is tangent to the outlet conveyor 129 in a transfer station S33 where, when the assembling drum 124 and the outlet conveyor 129 are standing still, a nearly complete cartridge 1 is transferred from a seat 127 of the assembling drum 124 to the outlet conveyor 129.

According to a preferred but not binding embodiment (schematically illustrated in FIG. 37), the transfer of an object between two successive conveyors of the assembling section 16 of the manufacturing machine 15 in a transfer station provides for the intervention of a pusher and a follower (or counter-pusher), which are in the transfer station and pinch the object to be transferred between one another; in other words, the pusher engages the object to be transferred on one side while the follower engages the object to be transferred on the other side in order to accurately control the position of the object during all of the transfer steps.

The seats that house the objects in the assembling section 16 of the manufacturing machine 15 can hold the objects by suction (which is interrupted when an object must leave a seat) or by means of fixed shields that prevent an object from leaving a seat (i.e. only in areas where the object must remain inside the seat).

As illustrated in FIG. 4, the feeding section 17 of the manufacturing machine 15 comprises a feeding device 130 for the supports 9 and the tubes 12, which feeds the tubes 12 to the feeding station S1 by means of a conveyor 131 and feeds the supports 9 to the feeding station S2 by means of a conveyor 132.

As illustrated in FIG. 4, the feeding section 17 of the manufacturing machine 15 comprises a feeding device 133 which feeds the mouthpieces 13 to the feeding station S19 (i.e. to the feeding device 83 of the feeding station S19) by means of a conveyor 134. According to a possible embodiment, the feeding device 133 receives a disorderly mass of mouthpieces 13 (i.e. a mass of mouthpieces 13 arranged in bulk) in a receiving tank open at the top and handles the mouthpieces 13 so as to arrange the mouthpieces 13 in an ordered succession which is then fed by the conveyor 134.

As illustrated in FIG. 4, the feeding section 17 of the manufacturing machine 15 comprises a feeding device 135 which feeds the tanks 5 to the feeding station S24 (i.e. to the feeding device 109 of the feeding station S24) by means of a conveyor 136. According to a possible embodiment, the feeding device 135 receives a disordered mass of tanks 5 (i.e. a mass of tanks 5 arranged in bulk) in a receiving tank open at the top and handles the tanks 5 so as to arrange the tanks 5 in an ordered succession which is then fed by the conveyor 136.

As illustrated in FIG. 4, the feeding section 17 of the manufacturing machine 15 comprises a feeding device 137 which feeds the plugs 11 to the feeding station S29 (i.e. to the feeding device 122 of the feeding station S29) by means of a conveyor 138. The sheet metal band 42 is unwound from a reel arranged vertically in an unwinding station which is arranged on the support body 18 of the assembling section 16 beside the initial part A (i.e. on the opposite side of the initial part A relative to the intermediate part B); preferably the unwinding station for the sheet metal band 42 is designed to perform an automatic change of the reel and therefore supports two reels arranged beside one another.

The embodiments described herein can be combined with one another without departing from the scope of the present invention.

The manufacturing machine 15 described above has numerous advantages.

Firstly, the manufacturing machine 15 described above allows to reach high production rates per hour (i.e. a number of pieces produced per time unit) while ensuring a high-quality standard of the cartridges 1.

Furthermore, the manufacturing machine 15 described above is also easy and inexpensive to manufacture, since it is made up of structurally simple elements which requires few movements which are easy to perform.

Finally, the manufacturing machine 15 described above provides adequate manoeuvring spaces around each component and therefore both the initial assembly of the components and the subsequent maintenance (from simple cleaning to replacement) of the components are simplified.

The invention claimed is:

1. A manufacturing machine (15) for the production of a cartridge (1) for an electronic cigarette; the cartridge (1) comprises: a tank (5); a heating device (6) provided with a wick (7), an electrical coil (8) wound in a spiral around the wick (7), and with a support (9), which has two "U"-shaped cavities housing, on the inside, the wick (7); two conductor elements (10), each having an inner end, which is connected to a corresponding end of the electrical coil (8); a plug (11), which is inserted into an end of the tank (5); a tube (12), which is connected to the support (9) of the heating device (6); a mouthpiece (13), where the tube (12) ends; and at least one absorbent pad (14), which is housed in the mouthpiece (13);

the manufacturing machine (15) comprising:

a first assembling drum (104), which can rotate around a first rotation axis (105), the first assembling drum (104) comprising: a first seat (106), which is designed to house the support (9) of the heating device (6) coupled to the wick (7) provided with the electrical coil (8) and a second seat (107), which is axially aligned with the first seat (106) and is designed to house the tank (5);

a first feeding station (S14), in which the support (9) of the heating device (6) coupled to the wick (7) provided with the electrical coil (8) is fed into the first seat (106);

a second feeding station (S24), in which the tank (5) is fed into the second seat (107); and a first insertion station (S25) which is arranged downstream of the first feeding station (S14) and of the second feeding station (S24) and is provided with a first pushing device (110), which axially moves the support (9) of the heating device (6) from the first seat (106) to the second seat (107), so as to insert the support (9) into the tank (5) carried by the second seat (107);

wherein the first feeding station (S14) is arranged downstream of the second feeding station (S24) relative to the rotation direction of the first assembling drum (104).

2. The manufacturing machine (15) according to claim 1 and comprising:

a second assembling drum (111), which rotates around a second rotation axis (112) parallel to the first rotation axis (105) and is provided with a third seat (113), which is designed to house the tank (5);

a first transfer station (S26), in which the tank (5) coupled to the support (9) is transferred from the second seat (107) of the first assembling drum (104) to the third seat (113) of the second assembling drum (111); and a bending station (S27) provided with a bending device (115) which bends a pair of conductor elements (10) integral to the support (9) of the heating device (6) arranged in the tank (5) carried by the third seat (113).

3. The manufacturing machine (15) according to claim 1 and comprising:

a third assembling drum (117), which rotates around a third rotation axis (118) parallel to the first rotation axis (105) and is provided with a fourth seat (119) designed to house the tank (5), and a fifth seat (120), which is axially aligned with the fourth seat (119) and is designed to house the plug (11);

a second transfer station (S27), in which the tank (5) coupled to the support (9) is transferred to the fourth seat (119) of the third assembling drum (117);

a third feeding station (S29), in which the plug (11) is fed into the fifth seat (120); and a second insertion station (S30) which is arranged downstream of the second transfer station (S27) and of the third feeding station (S29) and is provided with a second pushing device (123) which axially moves the plug (11) from the fifth seat (120) to the fourth seat (119), so as to insert the plug (11) into the tank (5) carried by the fourth seat (119).

4. The manufacturing machine (15) according to claim 1, and comprising:

a fourth assembling drum (124), which rotates around a fourth rotation axis (125) parallel to the first rotation axis (105) and is provided with a sixth seat (126), which is designed to house the tank (5), and a seventh seat (127), which is axially aligned with the sixth seat (126) and is designed to house the mouthpiece (13);

a third transfer station (S31), in which the tank (5) coupled to the support (9) is transferred to the sixth seat (126) of the fourth assembling drum (124) and, simultaneously, the mouthpiece (13) is transferred into the seventh seat (127); and a third insertion station (S32), which is arranged downstream of the third transfer station (S31) and the fourth feeding station and is provided with a third pushing device (128), which axially moves the tank (5) from the sixth seat (126) to the seventh seat (127), so as to insert the tank (5) into the mouthpiece (13) carried by the seventh seat (127).

5. The manufacturing machine (15) according to claim 1, wherein:

the first assembling drum (104) has an eighth seat (107), which is designed to house the mouthpiece (13); and in the first feeding station (S14), the support (9) is fed into the first seat (106) and, simultaneously, the mouthpiece (13) is fed into the eighth seat (107).

6. The manufacturing machine (15) according to claim 5 and comprising:

a second assembling drum (111), which rotates around a second rotation axis (112) parallel to the first rotation axis (105) and is provided with a third seat (113), which is designed to house the tank (5), and a ninth seat (114), which is designed to house the mouthpiece (13); and a first transfer station (S26), in which the tank (5) coupled to the support (9) is transferred from the second seat (107) of the first assembling drum (104) to the third seat (113) of the second assembling drum (111) and, simultaneously, the mouthpiece (13) is transferred from the eighth seat (107) of the first assembling drum (104) to the ninth seat (114) of the second assembling drum (111).

7. The manufacturing machine (15) according to claim 6 and comprising:

a third assembling drum (117), which rotates around a third rotation axis (118) parallel to the first rotation axis (105) and is provided with a fourth seat (119), which is designed to house the tank (5), and a tenth seat (121), which is designed to house the mouthpiece (13); and a second transfer station (S27), in which the tank (5) coupled to the support (9) is transferred from the third seat (113) of the second assembling drum (111) to the fourth seat (119) of the third assembling drum (117) and, simultaneously, the mouthpiece (13) is transferred from the ninth seat (114) of the second assembling drum (111) to the tenth seat (121) of the third assembling drum (117).

8. The manufacturing machine (15) according to claim 7 and comprising:

a fourth assembling drum (124), which rotates around a fourth rotation axis (125) parallel to the first rotation axis (105) and is provided with a sixth seat (126), which is designed to house the tank (5), and with a seventh seat (127), which is axially aligned with the sixth seat (126) and is designed to house the mouthpiece (13);

a third transfer station (S31) in which the tank (5) coupled to the support (9) is transferred from the fourth seat (119) of the third assembling drum (117) to the sixth seat (126) of the fourth assembling drum (124) and, simultaneously, the mouthpiece (13) is transferred from the tenth seat (121) of the third assembling drum (117) to the seventh seat (127) of the fourth assembling drum (124); and a third insertion station (S32), which is arranged downstream of the third transfer station (S31) and of the fourth feeding station and is provided with a third pushing device (128), which axially moves the tank (5) from the sixth seat (126) to the seventh seat (127), so as to insert the tank (5) into the mouthpiece (13) carried by the seventh seat (127).

9. A manufacturing method for the production of a cartridge (1) for an electronic cigarette; the cartridge (1) comprises: a tank (5); a heating device (6) provided with a wick (7), an electrical coil (8) wound in a spiral around the wick (7), and with a support (9), which has two "U"-shaped cavities housing, on the inside, the wick (7); two conductor elements (10), each having an inner end, which is connected to a corresponding end of the electrical coil (8); a plug (11), which is inserted into an end of the tank (5); a tube (12), which is connected to the support (9) of the heating device (6); a mouthpiece (13), where the tube (12) ends; and at least one absorbent pad (14), which is housed in the mouthpiece (13);

the manufacturing method comprises the steps of:

rotating around a first rotation axis (105) a first assembling drum (104) which comprises a first seat (106), which is designed to house the support (9) of the heating device (6) coupled to the wick (7) provided with the electrical coil (8), and a second seat (107), which is axially aligned with the first seat (106) and is designed to house the tank (5);

feeding, in a first feeding station (S14), the support (9) of the heating device (6) coupled to the wick (7) provided with the electrical coil (8) into the first seat (106);

feeding, in a second feeding station (S24), the tank (5) into the second seat (107); and inserting, in an insertion station (S25), which is arranged downstream of the first feeding station (S14) and of the second feeding station (S24), the support (9) of the heating device (6) into the tank (5) carried by the second seat (107), using a pushing device (110) which axially moves the support (9) from the first seat (106) to the second seat (107);

wherein the first feeding station (S14) is arranged downstream of the second feeding station (S24) relative to the rotation direction of the first assembling drum (104).

10. The manufacturing method according to claim 9 and comprising the further steps of:

rotating, around a second rotation axis (112), parallel to the first rotation axis (105), a second assembling drum (111), which is provided with a third seat (113) designed to house the tank (5);

transferring, in a first transfer station (S26), the tank (5) coupled to the support (9) from the second seat (107) of the first assembling drum (104) to the third seat (113) of the second assembling drum (111); and bending, by means of a bending device (115) arranged in a bending station (S27), a pair of conductor elements (10) integral to the support (9) of the heating device (6) arranged in the tank (5) carried by the third seat (113).

11. The manufacturing method according to claim 9 and comprising the further steps of:

rotating, around a third rotation axis (118), parallel to the first rotation axis (105), a third assembling drum (117), which is provided with a fourth seat (119), which is designed to house the tank (5) and a fifth seat (120), which is axially aligned with the fourth seat (119) and is designed to house the plug (11);

transferring, in a second transfer station (S27), a tank (5) coupled to the support (9) to the fourth seat (119) of the third assembling drum (117); feeding, in a third feeding station (S29), a plug (11) in the fifth seat (120); and axially moving by means of a second pushing device (123) arranged in a second insertion station (S30), which is arranged downstream of the second transfer station (S27) and of the third feeding station (S29), the plug (11), from the fifth seat (120) to the fourth seat (119) so as to insert the plug (11) into the tank (5) carried by the fourth seat (119).

12. The manufacturing method according to claim 9, and comprising the further steps of:

rotating, around a fourth rotation axis (125), parallel to the first rotation axis (105), a fourth assembling drum (124), which is provided with a sixth seat (126) designed to house the tank (5) and with a seventh seat (127), which is axially aligned with the sixth seat (126) and is designed to house the mouthpiece (13);

transferring, in a third transfer station (S31), a tank (5) coupled to the support (9,) to the sixth seat (126) of the fourth assembling drum (124) and, simultaneously, transfer the mouthpiece (13) in the seventh seat (127); and axially moving by means of a third pushing device (128) arranged in a third insertion station (S32), which is arranged downstream of the third transfer station (S31) and of the fourth feeding station, the tank (5) from the sixth seat (126) to the seventh seat (127) so as to insert the tank (5) into the mouthpiece (13) carried by the seventh seat (127).

13. The manufacturing method according to claim 9, wherein:

the first assembling drum (104) has an eighth seat (107), which is designed to house the mouthpiece (13); and in the first feeding station (S14) the support (9) is fed into the first seat (106) and, simultaneously, the mouthpiece (13) is fed into the eighth seat (107).

14. The manufacturing method according to claim 13 and comprising the further steps of:

rotating around a second rotation axis (112) parallel to the first rotation axis (105) a second assembling drum (111), which is provided with a third seat (113) designed to house the tank (5) and a ninth seat (114) designed to house the mouthpiece (13); and transferring, in a first transfer station (S26), the tank (5) coupled to the support (9) from the second seat (107) of the first assembling drum (104) to the third seat (113) of the second assembling drum (111) and simultaneously transferring the mouthpiece (13) from the eighth seat (107) of the first assembling drum (104) to the ninth seat (114) of the second assembling drum (111).

15. The manufacturing method according to claim 14 and comprising the further steps of:

rotating, around a third rotation axis (118) parallel to the first rotation axis (105) a third assembling drum (117), which is provided with a fourth seat (119) designed to house the tank (5) and a tenth seat (121) designed to house the mouthpiece (13); and transferring, in a second transfer station (S27), the tank (5) coupled to the support (9) from the third seat (113) of the second assembling drum (111) to the fourth seat (119) of the third assembling drum (117) and simultaneously transferring the mouthpiece (13) from the ninth seat (114) of the second assembling drum (111) to the tenth seat (121) of the third assembling drum (117).

* * * * *